US005310633A

United States Patent [19]

Yoshida et al.

[11] Patent Number: 5,310,633

[45] Date of Patent: May 10, 1994

[54] BLEACH-FIXING COMPOSITION FOR COLOR PHOTOGRAPHIC MATERIAL AND METHOD FOR PROCESSING A COLOR PHOTOGRAPHIC MATERIAL WITH THE SAME

[75] Inventors: Kazuaki Yoshida; Takatoshi Ishikawa, both of Minami-ashigara, Japan

[73] Assignee: Fuji Photo Film Co., Ltd., Minami-ashigara, Japan

[21] Appl. No.: 57,037

[22] Filed: May 5, 1993

[30] Foreign Application Priority Data

May 13, 1992 [JP] Japan ..... 4-146895
Mar. 18, 1993 [JP] Japan ..... 5-059014

[51] Int. Cl.[5] ..... G03C 7/42

[52] U.S. Cl. ..... 430/458; 430/459; 430/460

[58] Field of Search ..... 430/458, 459, 460

[56] References Cited

U.S. PATENT DOCUMENTS

| | | | |
|---|---|---|---|
| 2,482,546 | 9/1949 | Kaszuba | 430/401 |
| 2,494,903 | 1/1950 | Shiedler | 219/403 |
| 2,596,926 | 5/1952 | Gunther | 430/372 |
| 3,128,182 | 4/1964 | Bard et al. | 430/379 |
| 3,128,183 | 4/1964 | Jones et al. | 430/602 |
| 3,253,919 | 5/1966 | Beavers | 430/444 |
| 3,294,540 | 12/1966 | Goffe | 430/264 |
| 3,574,709 | 4/1971 | Frochlich | 560/148 |
| 3,582,346 | 6/1971 | Dersch | 430/602 |
| 3,813,247 | 5/1974 | Minsk | 430/627 |
| 4,230,796 | 8/1980 | Gunther et al. | 430/523 |
| 4,426,445 | 1/1984 | Minamizamo et al. | 430/599 |
| 5,055,384 | 10/1991 | Kühnert | 430/450 |
| 5,135,840 | 8/1992 | Reuter et al. | 430/458 |

FOREIGN PATENT DOCUMENTS

| | | |
|---|---|---|
| 1013192 | 1/1977 | Canada . |
| 0196551 | 10/1986 | European Pat. Off. . |
| 0355660 | 2/1990 | European Pat. Off. . |
| 226237 | 7/1912 | Fed. Rep. of Germany . |
| 4-19655 | 1/1992 | Japan . |

*Primary Examiner*—Hoa Van Le
*Attorney, Agent, or Firm*—Burns, Doane, Swecker & Mathis

[57] ABSTRACT

Disclosed is a powdery bleach-fixing composition which is substantially not caked during storage. The bleach-fixing composition for color photographic materials comprises a thiosulfate, an iron (III) complex compound or a salt thereof, and a sulfite, bisulfite or pyrosulfite, at least 50 molar % (in terms of sulfite ion equivalent) thereof being potassium salt.

10 Claims, No Drawings

BLEACH-FIXING COMPOSITION FOR COLOR PHOTOGRAPHIC MATERIAL AND METHOD FOR PROCESSING A COLOR PHOTOGRAPHIC MATERIAL WITH THE SAME

BACKGROUND OF THE INVENTION

The present invention relates to a processing agent for silver halide color photographic sensitive materials (hereinafter referred to merely as "photosensitive material") and a method for processing a color photographic material with the same. In particular, the present invention relates to a powdery bleach-fixing composition.

A silver halide color photographic sensitive material is processed, after exposure, by steps of color development, desilverization, washing with water, stabilization and the like. A color developer is used for the color development; a bleaching solution, bleach-fixing solution and fixing solution are used for the desilverization; city water or ion-exchanged water is used for washing with water; and a stabilizer is used for the stabilization. These processing solutions are usually controlled at a temperature of 30° to 40° C. and the photosensitive material is processed by immersing it in these processing solutions.

Since the capacities of these processing solutions are deteriorated after the processes or with the time period, they are exchanged with fresh ones by replenishment or batchwise method.

Therefore, it is required of the users to prepare the processing solutions prior to the processes. Even though many of the chemicals used for the preparation of the processing solutions are in solid form, they tend to react with each other to form undesirable reaction products when they are brought into contact with each other. Therefore, the users cannot get them in the form of a mixture.

Thus when the chemicals are reactive with each other, they are packed separately and given to the users, thereby increasing the costs of the package and transportation. Another problem is that users not skilled in the art might make a mistake in blending the chemicals.

Under these circumstances, the components of the processing solutions are parted from each other to prevent the reaction and the concentrates of them are given to the users so that only the dilution is required of the users.

For example, bleach-fixing solutions usually used comprises two concentrate parts, i.e. a part containing a bleaching agent and another part containing a fixing agent.

However, even though the concentrates are used, they are put in separate containers and therefore, they have not yet been made sufficiently compact.

Although the parts are in the form of the concentrates, they are yet liquids which necessitate dissolution step in the production of them to make the production process complicated. Further, problems are posed in the transportation, since they are in liquid form. In addition, precipitates are formed in the concentrates during the transportation and the redissolution of them is often difficult.

In European Patent Publication No. 196,551A and Japanese Patent Unexamined Published Application (hereinafter referred to as J. P. KOKAI) No. Hei 4-19655, it is proposed to use a powder composition and laminate the powder composition in layers. This intends to solve the disadvantage in the liquid form by use of powder composition and to stabilize it by forming a laminate comprising layers each containing grains of a constituent of the processing agent and an inert layer interposed between them so that the constituents reactive with each other will not react, the laminate being vacuum-packed.

However, these methods have problems in that the vacuum-packing is indispensable during the preparation to extremely increase the production cost and that the thiosulfate powder cakes to form a hard mass thereby making it difficult even to take out from the package.

J. P. KOKAI No. Hei 3-39735 discloses a fixing composition or bleach-fixing composition produced by mixing a thiosulfate and a pyrosulfite and granulating the resultant mixture. This technique also has problems in that the granulation is indispensable for preventing the lumping of the thiosulfate powder, thereby extremely increasing the production cost and that since the prevention of the thiosulfate from caking is insufficient, the granules cake when a high load is applied at a high temperatrue of 30° to 40° C. to make the practical use difficult. In addition, when the granulated composition is dissolved in water, it sometimes involves the production of smell due to sulfer dioxide ans the like.

SUMMARY OF THE INVENTION

A primary object of the present invention is to provide a powdery bleach-fixing composition consisting of only one part in a compact form and having an excellent storability.

The second object of the present invention is to provide a powdery bleach-fixing composition consisting of only one part which is prevented from caking of the thiosulfate, which can be dissolved in a shorter time than ordinary one and which can be easily processed.

The third object of the present invention is to provide a powdery bleach-fixing composition consisting of only one part and capable of forming an image having excellent photographic properties.

The forth object of the present invention is to provide a powdery bleach-fixing composition consisting of only one part which prevents from the production of smell when the composition is dissolved in water.

The fifth object of the present invention is to provide an effective method for processing silver halide color photographic materials with the powdery bleach-fixing composition.

These and other objects of the present invention will be apparent from the following description and Examples.

The first aspect of the present invention, there is provided a bleach-fixing composition for silver halide color photographic materials which has a one-part constitution comprising a mixture of at least the following three kinds of powdery compounds to (1) to (3):

(1) a thiosulfate, (2) an iron (III) complex compound or a salt thereof, and (3) a salt selected from the group consisting of sulfites, bisulfites and pyrosulfites in a container, at least 50 molar % (in terms of sulfite ion equivalent) of the salt(3) being potassium salt, The second aspect of the invention, there is provided a method for processing silver halide color photographic materials which comprises the steps of charging the powder composition from the container into water so as to dissolve it and treating the developed silver halide color photographic materials with the resulting bleach-fixing solution.

DESCRIPTION OF THE PREFERRED EMBODIMENTS

The detailed description will be made on the constitution of the present invention.

For preventing the caking of the thiosulfate powder, it is indispensable to mix the above-described powdery compounds (1) to (3). The term "powdery" herein indicates not only powdery but also granular. Preferably all the component (2) is powdery and still preferably all the components (1) to (3) are powdery.

However, the above-described condition is yet insufficient for prevention of the caking. After intenseve investigations, the inventors have found that when at least 50 molar % (in terms of sulfite ion equivalent) of the compounds (3) is potassium salt, the caking of the thiosulfate can be completely prevented. The compounds (3) are usually sodium and ammonium salts and it has been unknown that the potassium salt is remarkably effective in preventing the caking of the thiosulfate powder. Further, it is surprising that the powdery or granular mixture of the thiosulfate and the potassium salt (3) is insufficient for prevention of the caking and that the solidification can be completely prevented with a powdery mixture comprising these two compounds and the iron (III) complex compound or a salt thereof.

Further, the inventors have found that the compounds (3) are excellent from the viewpoint of the solubility and stability of the powdery mixture.

The present invention has been completed on the basis of the finding of use of component (2) and the potassium salts of component (3) as the powdery dispersants for the thiosulfate. The mechanism of the present invention is essentially different from that of the prevention of the caking with a granular mixture of a thiosulfate and a pyrosulfite disclosed in J. P. KOKAI No. Hei 3-39735.

The term "sulfite ion equivalent" means 1 equivalent in cases of sulfites and bisulfites (hydrogensulfites), and also means 2 equivalent in cases of pyrosulfites. For example, in case of 1 mol of sodium sulfite, 1 mol of potassium bisulfite and 1 mol of potassium pyrosulfite, mole ratio (K) of potassium salts with respect to sulfite ion equivalent can be shown by the following equation:

K (mol %)=100×(1 mol of potassium bisulfite+1 mol of potassium pyrosulfite×2 ion equivalents)/(1 mol of sodium sulfite+1 mol of potassium bisulfite+1 mol of potassium pyrosulfite×2 ion equivalents)=100 (1+1×2)/(1+1+1×2)=75 (mol %)

Preferably at least 80 molar % (in terms of sulfite ion equivalent), and still preferably 100 molar %, of the compounds (3) is potassium salt.

The compounds (3) of the present invention include sodium and ammonium salts in addition to the potassium salts.

In the compounds (3), pyrosulfites are most preferred and bisulfites and sulfites are the next.

Although the particle diameter of the powdery compounds (3) of the present invention are not particularly limited, it is preferably about 10 to 3,000 μm. The smaller the diameter, the better.

The iron (III) complex compounds (2) and salts of them are used as the bleaching agent in the present invention. They must be capable of being coexistent with the fixing agent for a given period of time. They are preferably ferric salts of organic acids. Ferric complex salts of aminopolycarboxylic acids are particularly preferred. Examples of them include ferric ethylened iaminetetraacetate [Fe (III) salt of EDTA], ferric die thylenetriaminepentaacetate, ferric cyclohexanediaminetetraacetate, ferric 1,3-diaminopropanetetraacetate, ferric 1,4-diam inobutanetetraacetate, ferric iminodiacetate, ferric m ethyliminodiacetate, ferric N-(2-acetamido)iminodiacetate and ferric nitrilotriacetate. Among them, Fe (III) salt of EDTA is particularly preferred.

The ferric salts of aminopolycarboxylic acids are usually ammonium salts or sodium salts and, in some cases, potassium salts. The ammonium salts are particularly preferred.

As for the particle diameter of the powdery compounds (2) of the present invention, it is particularly desirable that the diameter of at least 25% by weight of the particles is at most 150 μm. It is most desirable that the diameter of at least 35% by weight of them is at most 150 μm. Although the lower limit of the particle diameter is not particularly provided, it is usually 10μm. The particle diameter distribution of the compounds (2) is preferably about 10 to 1,000 μm, particularly preferably 10 to 300 μm.

The thiosulfates (1) are used as the fixing agent in the present invention. They include, for example, ammonium thiosulfate, sodium thiosulfate and potassium thiosulfate. Among them, ammonium thiosulfate is particularly preferred.

Although the particle diameter of the powdery compounds (1) is not particularly limited, it is preferably 10 to 3,000 μm.

The powdery bleach-fixing composition of the present invention comprises preferably 30 to 80% by weight, based on the whole composition, of the thiosulfate, 5 to 50% by weight of the preservative (the total of the sulfite, bisulfite and pyrosulfite) and 10 to 50% by weight of the iron (III) complex compound or its salt.

These powdery compounds are suitably mixed together and packed in one package to form the powdery product consisting of only one part. In order to obtain the homogeneous mixture, it is preferred that the average particle diameters of the powdery compounds are the same and that the particle size distribution of each of them is narrow.

The combination of the components (1), (2) and (3) constituting the bleach-fixing composition of the present invention can be, for example, a combination of $NH_3$ salt, $NH_3$ salt and potassium salt, respectively; combination of $NH_3$ salt, $NH_3$/potassium salt and potassium salt; combination of $NH_3$/potassium salt, $NH_3$ salt and potassium salt; and combination of potassium salt, potassium salt and potassium salt. Among them, the combination of $NH_3$ salt, $NH_3$ salt and potassium salt is preferred from the viewpoint of the solubility and desilverization.

Compounds which will be described below can be contained in the composition of the present invention in addition to those described above. These compounds must be in powder form.

In order to shorten the time period for dissolving the powder composition of the present invention and to prevent from the production of smell when the composition is dissolved, it is particularly preferable that an organic acid having an acid dissociation constant (pKa) of 4 to 6 or salt thereof be further incorporated into the composition of the present invention. The acid dissociation constant (pKa) used in the present invention indicates log of a reciprocal number of acid dissociation constant (Ka) value which is measured at ionic strength of 0.1 mol/liter at a temperature of 25° C.

The organic acid having an acid dissociation constant (pKa) of 4 to 6 may be a monobasic acid or polybasic acid, provided that aminopolycarboxilic acids and salts thereof are excluded Any organic acid having an acid dissociation constant (pKa) of 4 to 6 can be used in a powder form and may be used as metal salt thereof such as potassium salts and sodium salts or ammonium salts. The preferred are potassium salts and ammonium salts in the present invention, and the most preferred are ammonium salts. Among these, it is preferable that the organic acids or salts thereof be in the powder form having a particle size of 10 to 1000 μm.

Specific examples of the preferred organic acids include acetic acid, propionic acid, oxalic acid, malonic acid, succinic acid, glutaric acid, maleic acid, fumaric acid, citraconic acid, itaconic acid, β-hydroxypropionic acid, malic acid, tartaric acid, citric acid, oxalacetic acid, digycol acid, benzoic acid and phthalic acid. Among these, the preferred are acetic acid, oxalic acid, maleic acid, tartaric acid and malonic acid and the particular priferred are ammonium salts thereof.

The organic acids used in the present invention have more preferably an acid dissociation constant (pKa) of 4.2 to 5.8, most preferably 4.5 to 5.5.

It is preferable that the organic acid be incorporated into the powder composition of the present invention in an amount of 5 to 50 mol % relative to thiosulfates in order to shorten the time period for dissolving the powder composition of the present invention and to prevent from the production of smell when the composition is dissolved. It is further preferable that the organic acid be incorporated into the powder composition in an amount of 10 to 30 mol relative to thiosulfates.

The organic acid or salt can be used singly or in combination.

The composition of the present invention can contain organic acids which are different from those mentioned above, if necessary. In the organic acids, aminopolycarboxylic acids are preferred. In addition to the organic acids, salts of them such as alkali metal (e.g. sodium and potassium) salts, alkaline earth metal salts and onium (e.g. ammonium) salts are usable.

They are used for stabilizing the ferric salt of aminopolycarboxylic acid used as the bleaching agent. Usually ligand compounds in the bleaching agents are used. They are usable also as a pH adjustor.

For example, free ethylenediaminetetraacetic acid and monosodium salt thereof are strongly acidic and tetrasodium salt thereof is strongly alkaline.

Adducts of the bisulfites with, for example, an aldehyde can be further used in the present invention. Examples of them include formaldehyde, benzaldehyde and benzaldenyde-o-sulfonic acids.

Further, organic sulfinates such as p-toluenesulfinate and benzenesulfinate are also usable as the preservative in combination with the sulfites.

Bromides such as ammonium bromide and sodium bromide are usable as bleach accelerators in the present invention.

Inorganic salts can also be incorporated into the bleach-fixing composition, though they are not indispensable components. Examples of them include ammonium salts (such as ammonium chloride, ammonium bromide, ammonium sulfate and ammonium nitrate), sodium salts (such as sodium chloride, sodium bromide, sodium sulfate and sodium hydrogencarbonate), and potassium salts (such as potassium hydrogencarbonate, potassium chloride, potassium sulfate and potassium phosphate).

They are usable as a rehalogenating agent, pH buffering agent, anticorrosive agent for metals, etc. Other additives are also usable.

The amount of these compounds which varies depending on the variety of them is desirably at most 20% by weight, preferably 10 to 1% by weight, based on the whole bleach-fixing composition.

The composition can contain, in addition to the above-described compounds, powdery additives such as alkalis (e.g. ammonium carbonate, sodium hydroxide and potassium hydroxide) as pH adjustor, imidazoles and phosphates as the pH buffering agent, fluorescent brightening agents, defoaming agents, surfactants and known bleach-accelerators described in J. P. KOKAI No. Hei 1-26140 and the like.

The container used in the present invention is not particularly limited so far as it does not react with the bleach-fixing composition when it is brought into contact with the composition. Examples of the containers are those made of a resin such as polyethylene, polypropylene, nylon or vinylidene chloride or those made of a metal foil such as aluminum foil coated with such a resin. The shape of the containers is not particularly limited, either. The container may be a bottle with a lid, shrink package and the like. The powder composition of the present invention may be contained hermetically or not hermetically in the container.

The container used in the present invention preferably has a low oxygen permeability. Particularly preferably, the container is made of a flexible synthetic resin film having an oxygen permeability of 20 ml/m$^2$/24 h or below. The film may comprise only one resin layer or a laminate of two or more resin layers.

The materials of the film include, for example, (1) polyethylene terephthalate (PET), (2) acrylonitrile / butadiene copolymer, (3) rubber hydrochloride, (4) PET / polyvinyl alcohol / ethylene copolymer (Eval) / polyethylene (PE), (5) oriented polypropylene (OPP), (6) unoriented polypropylene (CPP) /Eval/ PE, (7) nylon (N) / aluminum foil (Al) / PE, (8) PET / Al / PE, (9) cellophane /PE / Al / PE, (10) Al / paper / PE, (11) PET / PE / Al / PE, (12) N / PE / Al /PE, (13) paper / PE / Al / PE, (14) PET / Al /PET / polypropylene (PP), (15) PET / Al /PET / high-density polyethylene (HDPE), (16) PET / Al /PE / low-density polyethylene (LDPE), (17) Eval / PP, (18) PET/ Al / PP, (19) paper / Al / PE, (20) PE / PVDC-coated nylon /PE / ethylvinyl acetate - polyethylene condensate (EVA), (21) PE / PVDC-coated N / PE, (22) EVA / PE / nylon coated with aluminum by vapor deposition/PE/EVA, (23) nylon coated with aluminum by vapor deposition / N / PE / EVA, (24) OPP / PVDC-coated N / PE, (25) PE / PVDC-coated N / PE, (26) OPP / Eval / LDPE, (27) OPP /Eval / CPP, (28) PET / Eval / LDPE, (29) ON (oriented nylon) /Eval / LDPE, (30) CN (unoriented nylon) / Eval / LDPE and (31) PET / N. In these materials, (20) to (31) are preferred.

In the present invention, (24) OPP / PVDC-N / PE and (31) PET / N are particularly preferred.

The thickness of these films which varies depending on the kind thereof is preferably 0.5 to 500 μm, particularly preferably 1 to 200 μm.

When the powdery bleach-fixing composition of the present invention is used after dissolving it in water, the concentration of the ferric salt of the organic acid in the bleach-fixing solution is preferably 5 to 500 mmol/l, particularly preferably 10 to 250 mmol/l.

The concentration of the thiosulfate is preferably 0.3 to 2 mol/l, still preferably 0.5 to 1.0 mol/l.

The concentration of the sulfite, bisulfite or metabisulfite used as the preservative is preferably 0.02 to 0.05 mol/l in terms of the sulfite ion.

The bleach-fixing solution usually contains silver in the form of soluble silver salt in an amount of about 0.03 to 0.12 mol/l. In the course of the process, the silver in the form of soluble silver salt is dissolved out of the photosensitive material and is accumulated.

pH of the bleach-fixing solution is preferably 7.0 or below, still preferably 5.0 to 6.5. It is particularly preferably 5.5 to 6.0.

The amount of the bleach-fixing solution to be replenished is preferably 20 to 300 ml, still preferably 25 to 200 ml and particularly preferably 30 to 100 ml, per square meter of the photosensitive material.

It is also desirable to add a regenerating agent to the overflowed bleach-fixing solution to reuse it as the replenisher. It is particularly preferred that the regenerating agent is the powdery bleach-fixing composition of one-part constitution of the present invention. The regeneration rate (percentage of the overflowed solution reused after regeneration based on the total overflowed solution) is preferably at least 50%, still preferably at least 90% and particularly at least 95%.

The description will be made on the color developer used in the present invention.

The color developer used in the present invention contains a well-known aromatic primary amine color developing agent. Preferred examples of the aromatic primary amines include p-phenylenediamine derivatives, typical Examples of which include N,N-diethyl-p-phenylenediamine, 2-amino-5-diethylaminotoluene, 2-amino-5-(N-ethyl-N-laurylamino)toluene, 4-[N-ethyl-N-( β-hydroxyethyl)amino]aniline, 2-methyl-4-[N-ethyl-N-(β-hydroxyethyl)amino]aniline, 4-amino-3-methyl-N-ethyl-N-[β-(methanesulfonamido)ethyl]-aniline, N-(2-amino-5-diethylaminophenylethyl)methane sulfonamide, N,N-dimethyl-p-phenylenediamine, 4-amino-3-methylN-ethyl-N-methoxyethylaniline, 4-amino-3-methyl-N-ethyl-N-β-ethoxyethylaniline and 4-amino-3-methyl- N-ethyl-N-β-butoxyethylaniline. Particularly preferred is 4-amino -3-methyl-N-ethyl-N-[β-(methanesulfonamido)ethyl]-aniline.

These p-phenylenediamine derivatives may be in the form of salts of them such as sulfates, hydrochlorides, sulfites and p-toluenesulfonates of them. The amount of the aromatic primary amine developing agent used is usually about 4 to 50 mmol per liter of the color developer. The amount of the color developing agent to be replenished is preferably about 21 to 45 mmol, still preferably about 23 to 40 mmol, per liter of the replenisher The process of the present invention is effective particularly for the concentrated color developing replenisher.

In conducting the present invention, a color developer substantially free from benzyl alcohol is preferably used from the viewpoint of the working atmosphere. The term "substantially free from benzyl alcohol" herein indicates that the benzyl alcohol concentration is preferably 2 ml/l or less, still preferably 0.5 ml/l or less and particularly preferably no benzyl alcohol is contained therein.

It is desirable that the color developer used in the present invention contains substantially no sulfite ion (i.e. the sulfite ion concentration is $3.0\times10^{-3}$ mol/l or below) in order to inhibit variation of the photographic properties during the continuous process. Most desirably, the color developer is completely free from sulfite ion. However, in the present invention, a very small amunt of sulfite ion used as an anti-oxidizing agent for the treating agent kit containing the concentrated developing agent before the preparation of the solution is excluded.

It is desirable that the color developer used in the present invention is substantially free from sulfite ion and also that this color developer is substantially free from hydroxylamine (i.e. the hydroxylamine concentration is $5.0\times10^{-3}$ mol/l or below) in order to inhibit variation of the photographic properties depending on the variation of the concentration of the hydroxylamine. It is most desirable that the color developer contains no hydroxylamine at all.

The color developer used in the present invention preferably contains an organic preservative in place of the above-described hydroxylamine or sulfite ion.

The term "organic preservatives" herein indicates all organic compounds which lower the deterioration rate of the aromatic primary amine color developing agent when they are added to the processing solution for color photosensitive material. Namely, they are organic compounds capable of preventing the color developing agent from oxidation by air or the like. Particularly effective organic preservatives include hydroxylamine derivatives (excluding hydroxylamine), hydroxamic acids, hydrazines, hydrazides, α-amino acids, phenols, α-hydroxyketones, α-aminoketones, saccharides, monoamines, diamines, polyamines, quaternary ammonium salts, nitroxy radicals, alcohols, oximes, diamide compounds and amines having a condensed ring. They are disclosed in, for example, J. P. KOKOKU No. Sho 48-30496, J. P. KOKAI Nos. Sho 52-143020, Sho 63-4235, Sho 63-30849, Sho 63-21647, Sho 63-44655, Sho 63-53551, Sho 63-43140, Sho 63-56654, Sho 63-58346, Sho 63-43138, Sho 63-146041, Sho 63-44657 and Sho 63-44656, U.S. Pat. Nos. 3,615,503 and 2,494,903, and J. P. KOKAI Nos. Hei 1-97953, Hei 1-186939, Hei 1-186940, Hei 1-187557, Hei 2-306244 and EP 0530921A1. Other preservatives usable, if necessary, include metals described in J. P. KOKAI Nos. Sho 57-44148 and Sho-53749, salicylic acids described in J. P. KOKAI No. Sho 59-180588, amines described in J. P. KOKAI Nos. Sho 63-239447, Sho 63-128340, Hei 1-186939 and Hei 1-187557, alkanolamines described in J. P. KOKAI No. Sho 56-94349 and aromatic polyhydroxy compounds described in U.S. Pat. No. 3,746,544. Particularly preferred are the alkanolamines such as triethanolamine; dialkylhydroxylamines such as N,N-diethylhydroxylamine and N,N-di(sulfoethyl)hydroxylamine; α-amino acid derivatives such as glycine, alanine, leucine, serine, threonine, valine, isoleucine; and aromatic polyhydroxy compounds such as sodium catechol-3,5-disulfonate.

A combination of the dialkylhydroxylamine with the alkanolamine or another combination of the dialkylhydroxylamine with α-amino acid derivatives represented by glycine and the alkanolamine disclosed in EP 0530921A1 is preferred for improving the stability of the color developer particularly in the course of the continuous process.

These organic preservatives may be in an amount sufficient to prevent the deterioration of color developing agents, preferably 0.01 ti 1.0 mol/l and more preferably 0.03 to 0.30 mol/l.

The color developer used in the present invention contains preferably $3.0\times10^{-2}$ to $1.5\times10^{-1}$ mol/l, particularly preferably $3.5\times10^{-2}$ to $1\times10^{-1}$ mol/l, of chlorine ion. When the chlorine ion concentration is higher than $1.5\times10^{-1}$ mol/l, the development is retarded unfavorably and, on the contrary, when it is below $3.0\times10^{-2}$ mol/l, fogging cannot be prevented.

The color developer used in the present invention contains preferably $3.0-10^{-5}$ to $1.0\times10^{-1}$ mol/l, particularly preferably $5.0\times10^{-5}$ to $5\times10^{-4}$ mol/l, of bromine ion. When the bromine ion concentration is higher than $1.0\times10^{-3}$ mol/l, the development is retarded and, on the contrary, when it is below $3.0\times10^{-5}$ mol/l, fogging cannot be sufficiently prevented.

The chlorine ion and bromine ion can be directly added to the color developer or they can be dissolved out of the photosensitive material in the course of the development.

When the chlorine ion is directly added to the color developer, the chlorine ion-feeding substances include sodium chloride, potassium chloride, ammonium chloride, lithium chloride, magnesium chloride and calcium chloride. The chlorine ion can be fed from a fluorescent brightener added to the color developer.

The bromine ion-feeding substances include sodium bromide, potassium bromide, ammonium bromide, lithium bromide, calcium bromide and magnesium bromide.

When the chlorine ion or bromine ion is dissolved out of the photosensitive material in the course of the development, such an ion can be fed by an emulsion or another substance.

The color developer used in the present invention has a pH of preferably 9 to 12, still preferably 9 to 11.0. The color developer may contain other compounds known to be components of developers.

Buffering agents are preferably used for keeping the above-described pH. The buffering agents usable herein include, for example, carbonates, phosphates, borates, tetraborates, hydroxybenzoates, glycyl salts, N,N-dimethylglycine salts, leucine salts, norleucine salts, guanine salts, 3,4-dihydroxyphenylalanine salts, alanine salts, aminobutyric acid salts, 2-amino-2-methyl-1,3-propanediol salts, valine salts, proline salts, trishy droxyaminomethane salts and lysine salts. In these compounds, the carbonates, phosphates, tetraborates and hydroxybenzoates which are inexpensive and which have a high solubility and excellent buffering capacity at a pH of as high as at least 9.0 are particularly preferably used without exerting any bad influence on the Photographic properties (such as fogging).

Examples of the buffering agents include sodium carbonate, potassium carbonate, sodium hydrogencarbonate, potassium hydrogencarbonate, trisodium phosphate, tripotassium phosphate, disodium phosphate, dipotassium phosphate, sodium borate, potassium borate, sodium tetraborate (borax), potassium tetraborate, sodium o-hyroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate).

The amount of the buffering agent to be added to the color developer is preferably at least 0.1 mol/l, particularly 0.1 to 0.4 mol/l.

The color developer can further contain chelating agents for preventing calcium or magnesium from precipitation or for improving the stability of the color developer. Examples of the chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylene-phos-phonic acid, transcyclohexanediaminetetraacetic acid, 1,2-diaminopropanetetraacetic acid, glycol ether diaminetetraacetic acid, ethylenediamine o-hydroxyphenylacetic acid, 2-phosphonobutane-1,2,4-tricarboxylic acid, 1-hydroxyethylidene-1,1-diphosphonic acid, N,N'-bis(2-hydroxybenzyl) ethylenediamine-N,N'-diacetic acid and hydroxyethyliminodiacetic acid. These chelating agents can be used either singly or, if necessary, in combination of two or more of them.

The amount of the chelating agent is such that is enough for sequestering the metal ions in the color developer, such as 0.1 to 10 g per liter.

The color developer can contain, if necessary, a development accelerator.

The development accelerators include thioether compounds described in J. P. KOKOKU Nos. Sho 37-16088, Sho 37-5987, Sho 38-7826, Sho 44-12380 and Sho 45-9019 and U.S. Pat. No. 3,813,247; p-phenylenediamine compounds described in J. P. KOKAI Nos. Sho 52-49829 and Sho 50-15554; quaternary ammonium salts described in J. P. KOKAI No. Sho 50-137726, J. P. KOKOKU No. Sho 44-30074 and J. P. KOKAI Nos. Sho 56-156826 and Sho 52-43429; amine compounds described in U.S. Pat. Nos. 2,494,903, 3,128,182, 4,230,796 and 3,253,919, J. P. KOKOKU No Sho 41-11431 and U.S. Pat. Nos. 2,482,546, 2,596,926 and 3,582,346; polyalkylene oxides described in J. P. KOKOKU Nos. Sho 37-16088 and Sho 42-25201, U.S. Pat. No. 3,128,183, J. P. KOKOKU Nos. Sho 41-11431 and Sho 42-23883 and U.S. Pat. No. 3,532,501; as well as 1-phenyl-3-pyrazolidones and imidazoles. Benzyl alcohol is as described above.

If necessary, an antifoggant can be used, if necessary. The antifoggants include alkali metal halides such as sodium chloride, potassium bromide and potassium iodide, and organic antifoggants Typical examples of the organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

The color developer used in the present invention preferably contains a fluorescent brightener such as a 4,4'-diamino-2,2'-disulfostilbene compound in an amount of 0 to 5 g/l, desirably 0.1–4 g/l.

If necessary, a surfactant such as an alkylsulfonic acid, arylsulfonic acid, aliphatic carboxylic acid, aromatic carboxylic acid or polyalkyleneimine can be incorporated into the color developer.

The color developer used in the present invention is processed at a temperature of 20° to 50°C., preferably 30° to 40° C. for 20 sec to 5 min, preferably 30 sec to 2 min. The amount of the replenisher is desirably as small as possible. It is 20 to 600 ml, preferably 30 to 200 ml and still preferably 30 to 150 ml, per $m^2$ of the photosensitive material.

The description will be made on the desilverization step according to the present invention. The desilverization step in the present invention involves a bleach-fixing step. The bleach-fixing step include the bleach-fixing step per se, bleaching / bleach-fixing step, bleach-fixing step / fixing step, and bleaching step / bleach-fixing step / fixing step. From the viewpoints of the facilitation and acceleration of the desilverization step, it singly consists of the bleach-fixing step. In the present invention, the bleach-fixing step is conducted by charging the powder composition from the container for the composition into water so as to dissolve it in an appropriate amount and treating the thus-developed silver halide color photographic materials with the resulting bleach-fixing solution at a temperature of 30° to 40° C. for 15 sec to 2 minutes. In this connection, it is preferable that the developed silver halide color photographic materials be passed into the bleach-fixing solution (bleach-fixing bath) and a replenishing solution prepared with the powder composition of the present invention be replenished into the bleach-fixing bath.

The description will be made on washing with water and/or stabilization step in the present invention.

After completion of the desilverization treatment such as fixing or bleach-fixing treatment, washing with water and/or stabilization is conducted in the present invention.

The amount of the replenisher in the step of washing with water or stabilization step is 3 to 50 times, preferably 3 to 30 times, and still preferably 3 to 10 times, as much as that carried over from the pre-processing bath per a unit area of the photosensitive material. In case the step of washing with water is followed by the stabilization step, the process of the present invention is effective when the amount of the replenisher in at least the final stabilization step is 3 to 50 times as much as that carried over from the bath. The replenishment can be conducted either continuously or intermittently. The liquid used for washing-with-water and/or stabilization step can be used in also the preceding step. For example, the liquid is saved by employing a multi-stage countercurrent method, wherein water used for washing and overflowed is introduced in the preceding bleach-fixing bath, and the concentrate is replenished into the bleach-fixing bath to reduce the quantity of the waste liquid.

The amount of water used in the step of washing-with-water can be variously fixed depending on the properties and use of the photosensitive material (according to the starting materials such as the coupler used), temperature of the water for washing, number of the tanks for washing-with-water (number of stages), replenishing method (countercurrent or down-flow system) and various other conditions. The number of the stages in the multi-stage countercurrent method is usually preferably 2 to 6, particularly 2 to 4.

The amount of water used for washing can be remarkably reduced by employing the multi-stage countercurrent method For example, the amount of water can be reduced to 0.5 to 1 l or less per $m^2$ of the photosensitive material. However, in such a case, the residence time of water in the tank is prolonged to cause propagation of bacteria and to form a suspended matter, which is adhered to the photosensitive material. Such a problem can be extremely effectively solved by a method described in J. P. KOKAI No. Sho 62-288838 wherein the amount of calcium and magnesium is reduced In addition, germicides can be used, which include isothiazolone compounds and thiabendazoles described in J. P. KOKAI No. Sho 57-8542, chlorine-containing germicides such as chlorinated sodium isocyanurate described in J. P. KOKAI No. Sho 61-120145, benzotriazole described in J. P. KOKAI No. Sho 61-267761, copper ions and other germicides described in Hiroshi Moriguchi "Bokin Bobai no Kagaku" published by Sankyo Shuppan in 1986, "Biseibutsu no Mekkin, Sakkin, Bobai Gijutsu" edited by Eisei Gijutsu kai and published by Kogyo Gijutsu kai in 1982, and "Bokin Bobaizai Jiten" edited by Nippon Bokin Bobai Gakkai and published in 1986.

Water used for washing can contain a surfactant as a dehydrating agent and a chelating agent typified by EDTA as a softening agent for hard water.

The photosensitive material can be treated with a stabilizer directly or after the above-described step of washing with water. The stabilizer contains a compound having a function of stabilizing an image. The compounds include, for example, aldehyde compounds typified with formalin, buffering agents for adjusting pH suitably for the stabilization of the dyes and ammonium compounds. Further the above-described germicides and antifungal agents can be used for preventing the propagation of the bacteria in the liquid or for imparting antifungal properties to the treated photosensitive material.

Further a surfactant, fluorescent brightener and hardener can also be incorporated into the photosensitive material. When the photosensitive material is directly stabilized without the preceding step of washing with water in the treatment of the photosensitive material in the present invention, any of known methods described in J. P. KOKAI Nos. Sho 57-8543, Sho 58-14834, Sho 60-220345, etc. can be employed.

In a preferred embodiment, a chelating agent such as 1-hydroxyethylidene-1,1-diphosphonic acid or ethylenediamine tetramethylenephosphonic acid, or a magnesium or bismuth compound is used.

A so-called "rinse" can also be used as washing water or stabilizer to be used after completion of the desilverization treatment.

The pH in the step of washing with water or stabilization is preferably 4 to 10, still preferably 5 to 8. The temperature which is variable depending on the use and character of the photosensitive material is usually 15° to 45° and preferably 20° to 40° C. From the viewpoint of the reduction of the treatment time, the shorter the time, the better. The treatment time is thus preferably 15 sec to 1 min 45 sec, still preferably 30 sec to 1 min 30 sec.

After the washing with water or stabilization, the silver halide color photographic materilas may be dried, for example, at a temperature of 50° to 90° C. for 15 sec to 5 minutes.

The present invention is applicable to any photosensitive material. The silver halide emulsion and other materials (such as additives) usable in the present invention, photographic constituting layers (such as arrangement of the layers), as well as methods for processing the photosensitive material and additives usable therefor are described in patents listed below, particularly European Patent No. 0,355,660A2 (Japanese Patent Application No. Hei 1-107011).

| Photographic constituent, etc. | J.P. KOKAI No. Sho 62-215272 |
|---|---|
| Silver halide emulsion | From line 6, right upper column, p. 10 to line 5, left lower column, p. 12; and from line 4 from below, right lower column, p. 12 to line 17, left upper column, p. 13 |
| Solvent for silver halide | Lines 6 to 14, left lower column, p. 12; and from line 3 from below, left upper column, p. 13 to the last line, left lower column, p. 18 |
| Chemical sensitizer | Line 3 from below, left lower column, p. 12; line 5 from below, right lower column, p. 12; and from line 1, right lower column, p. 18, to line 9 from below, right upper column, p. 22 |
| Spectral sensitizer (spectral sensitizing method) | From line 8 from below, right upper column, p. 22 to the last line, p. 38 |
| Emulsion stabilizer | From line 1, left upper column, p. 39 to the last line, right upper column, p. 72 |
| Development accelerator | From line 1, left lower column, p. 72 to line 3, right upper column, p. 91 |
| Color coupler(cyan, magenta or yellow coupler) | From line 4, right upper column, p. 91 to line 6, left upper column, p. 121 |
| Color development improver | From line 7, left lower column, p. 121 to line 1, right upper column, p 125 |

TABLE 2

| Photographic constituent, etc. | J.P. KOKAI No. Sho 62-215272 |
|---|---|
| Ultraviolet absorber | From line 2, right upper column, p. 125 to the last line, left lower column, p. 127 column, p. 127 |
| Decoloration inhibitor (image stabilizer) | From line 1, right lower column, p. 127 to line 8, left lower column, p. 137 |
| High boiling and/or low boiling organic solvent | From line 9, left lower column, p. 137 to the last line, right upper column, p. 144 |
| Dispersion method for photographic additive | From line 1, left lower column to line 7, right upper column, p. 146 |
| Antistaining agent | From line 9, right lower column, p. 188 to line 10, right lower column, p. 193 |
| Surfactant | From line 1, left lower column, p. 201 to the last line, right upper column, p. 210 |
| Fluorine-containing compound (as anti-static agent, coating assistant, lubricant, adhesion inhibitor, etc.) | Line 1, left lower column, p. 210; and line 5, left lower column, p. 222 |

TABLE 3

| Photographic constituent, etc. | J.P. KOKAI No. Sho 62-215272 |
|---|---|
| Binder (hydrophilic colloid) | From line 6, left lower column, p. 222 to the last line, left upper column, p. 225 |
| Thickening agent | From line 1, right upper column, p. 225 to line 2, right upper column, p. 227 |

TABLE 3-continued

| Photographic constituent, etc. | J.P. KOKAI No. Sho 62-215272 |
|---|---|
| Antistatic agent | From line 3, right upper column, p. 227 to line 1, left upper column, p. 230 |
| Hardener | From line 8, right upper column, p. 146 to line 4, left lower column, p. 155 |
| Developing agent precursor | From line 5, left lower column, p. 155 to line 2, right lower column, p. 155 |
| Development inhibitor releasing compound | Lines 3 to 9, right lower column, p. 155 |
| Support | Line 19, right lower column, p. 155; and line 14, left upper column, p. 156 |
| Constitution of photosensitive layers | From line 15, left upper column, p. 156 to line 14, right lower column, p. 156 |
| Dye | From line 15, right lower column, p. 156 to the last line, right lower column, p. 184 |
| Color mixing inhibitor | From line 1, left upper column, p. 185 to line 3, right lower column, p. 188 |
| Gradation controller | Lines 4 to 8, right lower column, p. 188 |
| Polymer latex | From line 2, left upper column, p. 230 to the last line, p. 239 |
| Matting agent | From line 1, left upper column, p. 240 to the last line, right upper column, p. 240 |
| Photographic process (steps and additives) | From line 7, right upper column, p. 3 to line 5, right upper column, p. 10 |

Notes)
The cited portions of J.P. KOKAI No. Sho 62-215272 includes also those amended by the Written Amendment dated March 16, 1987 as stated at the end of this patent publication. Among the above-described couplers, preferred yellow couplers are so-called short-wave tyoe yellow couplers described in J.P. KOKAI Nos. Sho 63-231451. Sho 63-123047, Sho 63-241547, Hei 1-173499, 1-213648 and 1-250944.

TABLE 4

| Photographic constituent, etc. | J.P. KOKAI No. Hei 2-33144 | EP 0,355,660A2 |
|---|---|---|
| Silver halide emulsion | From line 16, right upper column, p. 28 to line 11, right lower column, p. 29; and lines 2 to 5, p. 30 | From line 53, p. 45 to line 3, p. 47; and lines 20 to 22, p. 47 |
| Chemical sensitizer | From line 12, right lower column, to the last line, p. 29 | Lines 4 to 9, p. 47 |
| Spectral sensitizer (spectral sensitizing method) | Lines 1 to 13, left upper column, p. 30 | Lines 10 to 15, p. 47 |
| Emulsion stabilizer | From line 14, left upper column to line 1, right upper column, p. 30 | lines 16 to 19, p. 47 |
| Color coupler (cyan, magenta or yellow coupler) | From line 14, right upper column, 3 to the last line, left upper column, p. 18; and from line 6, | Lines 15 to 27, p. 4; from line 30, p. 5 to the |

TABLE 4-continued

| Photographic constituent, etc. | J.P. KOKAI No. Hei 2-33144 | EP 0,355,660A2 |
|---|---|---|
| | right upper column, p. 30 to line 11, right lower column, p. 35 | last line, p. 28; lines 29 to 31, p. 45; and from line 23, p. 47 to line 50, p. 63 |
| Ultraviolet absorber | From line 14, right lower column, p. 37 to line 11, left upper column, p. 38 | Lines 22 to 31, p. 65 |
| Decoloration inhibitor (image stabilizer) | From line 12, right upper column, p. 36 to line 19, left upper column, p. 37 | From line 30, p. 4 to line 25, p. 45; lines 33 to 40, p. 45; and lines 2 to 21, p. 65 |
| High boiling and/ or low boiling organic solvent | From line 14, right lower column, p. 35 to line 4 from below. left upper column, p. 36 | Lines 1 to 51, p. 64 |
| Dispersion method for photographic additive | From line 10, right lower column, p. 27 to the last line, left upper column, p. 28; and from line 12, right lower column, p. 35 to line 7, right upper column, p. 36 | From line 51, p. 63 to line 56, p. 64 |
| Antistaining agent | The last line, left upper column, p. 37 and line 13, right lower column, p. 37 | From line 32, P. 65 to line 17, p. 66 |

TABLE 5

| Photographic constituent, etc. | J.P. KOKAI No. Hei 2-33144 | EP 0,355,660A2 |
|---|---|---|
| Surfactant | From line 1, right upper column, p. 18 to the last line, right lower column, p 24; and from line 10 from below, left lower column, p. 27 to line 9, right lower column, p. 27 | — |
| Fluorine-containing compound (as anti-static agent, coating assistant, lubricant, adhesion inhibitor, ect.) | Line 1, left upper column, p. 25 to line 9, right upper column, p. 27 | — |
| Binder (hydrohilic colloid) | Lines 8 to 18, right upper column, p. 38 | Lines 23 to 28, p. 66 |
| Support | From line 18, right upper column, p. 38 to line 3, left upper column, p. 39 | From line 29, p. 66 to line 13, p. 67 |
| Constitution of photosensitive layers | Lines 1 to 15, right upper column, p. 28 | Lines 41 to 52, p. 45 |
| Dye | From line 12, left upper column to line 7, right upper column, p. 38 | Lines 18 to 22, p. 66 |
| Color mixing inhibitor | Lines 8 to 11, right upper column, p. 36 | From line 57, p. 64 to line 1, p. 65 |
| Photographic process (steps and aditives | From line 4, left upper column, p 39 to the last line, left upper column, p. 42 | From line 14, p. 67 to line 28, p. 69 |

Preferred cyan couplers include diphenylimidazole cyan couplers described in J. P. KOKAI No. Hei 2-33144 as well as 3-hydroxypyridine cyan couplers described in European Patent EP No. 0,333,185A2 particularly preferred are those produced by converting the listed tetravalent coupler (42) into divalent one by introducing a chlorine-linked coupling off group, and couplers (6) and (9)] and cyclic active methylene cyan couplers (particularly preferred are couplers 3, 8 and 34).

The silver halides usable in the present invention include, for example, silver chloride, silver bromide, silver chlorobromide, silver chlorobromoiodide and silver bromoiodide. For the rapid process, it is desirable to use silver chlorobromide or silver chloride emulsion substantially free from silver iodide and having a silver chloride content of at least 90 molar %, preferably at least 95 molar % and particularly preferably at least 98 molar %. The photosensitive material used in the process of the present invention is particularly preferably a color photosensitive material for printing which has a high silver chloride content (such as a color paper).

The photosensitive material of the present invention preferably contains a dye (particularly an oxonol dye)

which can be decolored by a treatment described on pages 27 to 76 of European Patent EP No. 0,337,490A2 in its hydrophilic colloidal layer so that the optical reflection density of the photosensitive material at 680 nm will be at least 0.70, or at least 12% by weight (more desirably at least 14% by weight) of titanium oxide surface-treated with a dihydric to tetrahydric alcohol (such as trimethylolethane) in the water-resistant resin layer of the support.

The photosensitive material of the present invention preferably contains a compound for improving the color image storability, such as a compound described in European Patent No. 0,277,589A2 in combination with the coupler which is particularly preferably a pyrazoloazole coupler.

In order to prevent the staining and other bad effect caused by, for example, a developed dye formed by reaction of a color developing agent remaining in the film or its oxidation product with the coupler in the course of the storage after the processing, it is desirable to use a compound (F) capable of forming a chemically inert, substantially colorless compound by being chemically bonded with an aromatic amine developing agent remaining after the color developing process and/or a compound (G) capable of forming a chemically inert, substantially colorless compound by being chemically bonded with an oxidation product of an aromatic amine developing agent remaining after the color developing process.

It is also preferred to incorporate an antifungal agent described in, for example, J. P. KOKAI No. Sho 63-271247 in order to prevent the propagation of molds and bacteria in the hydrophilic colloidal layer to deteriorate the image into the photosensitive material according to the present invention.

To improve the adhesion of the color photosensitive material after the process, it is particularly preferred that the degree of swelling of the photographic layer of the silver halide color photosensitive material is 1.2 to 3.0 in the present invention.

The term "degree of swelling" herein indicates a value obtained by dividing the thickness of the photographic layer after immersion of the color photosensitive material in distilled water having a temperature of 33° C. for 2 min by the thickness of the dry photographic layer. It is still preferably 1.3 to 2.7.

The term "photographic layer" herein incidates a laminate comprising at least one photosensitive silver halide emulsion layer and a hydrophilic colloidal layer, these layers being permeable to water. The photographic layer include no back layer positioned on the support on a side opposite to the photographic photosensitive layer. The photographic layer usually comprises two or more layers which participate in the photographic image formation, namely an intermediate layer, filter layer, antihalation layer and protective layer formed outside the silver halide emulsion layer.

The degree of swelling can be controlled within the range of the present invention by any unlimited method. For example, it can be controlled by varying the amount and kind of the gelatin and hardener in the photographic layer or by varying the drying conditions after application of the photographic layer. The photographic layer advantageously comprises gelatin. Another hydrophilic colloid is also usable. The hydrophilic colloids include proteins such as gelatin derivatives, graft polymer of gelatin and another polymer, alubmin and casein; cellulose derivatives such as hydroxyethylcellulose, carboxymethylcellulose and cellulose sulfate; saccharide derivatives such as sodium alginate and starch derivatives; and synthetic hydrophilic polymers including homopolymers and copolymers such as polyvinyl alcohol, partial acetal of polyvinyl alcohol, poly-N-vinylpyrrolidone, polyacrylic acid, polymethacrylic acid, polyacrylamide, polyvinylimidazole and polyvinylpyrazole.

Gelatins usable herein include gelatin treated with lime, gelatin treated with an acid, gelatin hydrolyzate and decomposition products of gelatin with an enzyme. The gelatin derivatives include reaction products of gelatin with various compounds such as acid halides, acid anhydrides, isocyanates, bromoacetic acid, alkane sultones, vinyl sulfonamides, maleimide compounds, polyalkylene oxides and epoxy compounds.

The above-described grafted polymers of gelatin include products obtained by grafting acrylic acid, methacrylic acid, a derivative such as an ester or amide of such an acid, or a homopolymer or copolymer of a vinyl monomer such as acrylonitrile or styrene onto gelatin. Particularly preferred are graft polymers of gelatin with a polymer which is considerably compatible with gelatin such as a polymer of acrylic acid, methacrylic acid, acrylamide, methacrylamide or hydroxyacryl methacrylate. Examples of them are given in U.S. Pat. Nos. 2,763,625, 2,831,767 and 2,956,884. Typical synthetic hydrophilic polymeric substances are described in, for example, West German Patent Application (OLS) No. 2,312,708, U.S. Pat. Nos. 3,620,751 and 3,879,205, and J. P. KOKOKU No. Sho 43-7561.

The hardeners include, for example, chromium salts (such as chromium alum and chromium acetate), aldehydes (such as formaldehyde, glyoxal and glutaraldehyde), N-methylol compounds (such as dimethylol urea and methylol dimethylhydantoin), dioxane derivatives (such as 2,3-dihydroxydioxane), active vinyl compounds (such as 1,3,5-triacryloylhexahydro-s-triazine, bis(vinylsulfonyl)methyl ether and N,N'-methylenebis-[β-(vinylsulfonyl)propionamide]), active halogen compounds (such as 2,4-dichloro-6-hydroxy-s-triazine), mucohalogen acids (such as mucochloric acid and mucophenoxychloric acid), isoxazoles, dialdehyde starches and 2-chloro-6-hydroxytriazinylgelatin. They can be used either singly or in combination of two or more of them.

Particularly preferred hardeners are the aldehydes, active vinyl compounds and active halogen compounds.

The supports used for forming the photosensitive material according to the present invention include, for example, a white polyester support for display and a support having a white pigment-containing layer on a silver halide emulsion layer side. To improve the sharpness, it is desirable to form an antihalation layer on the same side as that of the silver halide emulsion layer or on the opposite side of the support. It is particularly desirable to make the support so that the transmittance is in the range of 0.35 to 0.8 in order that the display can be seen by using either reflected light or transmitted light.

The photosensitive material according to the present invention can be exposed to either visible light or infrared light. The exposing method may be either a low-illuminance exposure or high-illuminance exposure / short time method. In the latter, a laser scanning exposure method wherein the exposure time per pixel is shorter than $10^{-4}$ sec is preferred.

In the exposure, a band stop filter described in U.S. Pat. No. 4,880,726 is preferably used. With this filter, color mixing by light is inhibited and the color reproducibility is remarkably improved.

EXAMPLES

The following Examples will further illustrate the present invention.

EXAMPLE 1

The components constituting the bleach-fixing solution are given below They are each in the form of a powder (solid).

| | | |
|---|---|---|
| Bleaching agent: | ferric ammonium ethylenediamine-tetraacetate dihydrate (particle size of 10 to 300 μm) (wt. % of particles having a diameter of 150 μm or below: see Table 6) | 1300 g |
| Fixing agent: | ammonium thiosulfate (particle size of 10 to 1000 μm) | 1700 g |
| Preservative: | see Table 6 (in terms of sulfiteion) (particle size of 10 to 1000 μm) | 8.5 mol |

These components were thoroughly blended together and fed into a bag made of a laminated resin film of polypropylene / vinylidene oxide-coated nylon / polyethylene (thickness: 70 μm) to prepare processing agents A to K. A processing agent L free of bleaching agent and processing agent M free of preservative and bleaching agent were also prepared.

The processing agents A to N prepared as described above were stored at 50° C. at relative humidity of 90% for 8 weeks and then dissolved in water kept at 10° C. with a stirrer provided with a propeller shaft under predetermined stirring conditions.

The processing agents to which a load of 1 kg/100 $cm^2$ was applied were stored in the same manner as that described above.

In the dissolution of the processing agents A to Z in water kept at 10° C., the dissolution time was macroscopically determined with an infrared scope in every case.

The ratio of the amount of ferrous ion to the total amount of iron in each of the bleach-fixing solutions thus obtained was determined and the preservative properties were evaluated. The ratio was determined according to o-phethanthroline coloring method.

A load of 1 kg/100 $cm^2$ was applied to each sample and degree of caking of the powder was determined.

The results are given in Table 6.

TABLE 6

| No. | Bleach-fixing composition | Preservative (molar ratio) | Amount of particles of diameter of 150 μm or less in bleaching agent (wt. %) | Degree of caking* Without load | Degree of caking* Under load | Dissolution time (min) | Ratio of $Fe^{2+}$/ total Fe ( %) |
|---|---|---|---|---|---|---|---|
| 1 | A | $Na_2S_2O_5$ | 20 | X | XX | 20.5 | 14.3 |
| 2 | B | $Na_2S_2O_5$ (granules with ammonium thiosulfate; av. diameter: 300 μm) | 20 | X | XX | 18.0 | 15.2 |
| 3 | C | $Na_2SO_3$ | 20 | X | XX | 21.0 | 9.8 |
| 4 | D | $(NH_4)_2SO_3$ | 20 | XX | XX | 20.5 | 20.6 |
| 5 | E | $NaHSO_3$ | 20 | X | XX | 15.0 | 8.9 |
| 6 | F | $Na_2S_2O_5$:$K_2S_2O_5$ = 1:1 | 20 | ○ | Δ | 8.0 | 2.9 |
| 7 | G | $K_2SO_3$ | 20 | ○ | ○ | 7.0 | 3.2 |
| 8 | H | $KHSO_3$ | 20 | ○ | ○ | 6.0 | 2.6 |
| 9 | I | $K_2S_2O_5$ | 20 | ◎ | ○ | 5.5 | 2.5 |
| 10 | J | " | 30 | ◎ | ◎ | 5.5 | 2.0 |
| 11 | K | " | 35 | ◎ | ◎ | 5.0 | 1.8 |
| 12 | L | " | no bleaching agent | XX | XX | 59.0 | — |
| 13 | M | no preservative | " | XX | XX | 60.5 | — |

Nos. 1 to 5 and 12 to 13 are comparative examples and Nos. 6 to 11 are examples of the present invention.
*Evaluation of degree of caking:
◎: The powder was dry and not caked at all.
○: Although small masses were formed, they practically caused no problem.
Δ: Although the powder was partially caked, the formed masses could be broken by hand, which practically posed no problem.
X: The powder was partially caked to form masses which could not be broken by hand, which was practically troublesome.
XX: The powder was wholly caked and could not be easily taken out of the bag, which was practically seriously troublesome.

It will be understood from Table 6 that according to the constitution of the present invention, the caking of the powder was remarkably prevented. Other advantages apparent from Table 6 are short dissolution time and remarkably improved processability. The fact that the amount of ferrous ion formed was only small indicated that the bleaching agent was kept stable.

It is apparent from No. 2 that when sodium pyrosulfite used as the preservative was mixed with ammonium thiosulfate and the mixture was granulated to form granules having an average diameter of 300 μm, the effect of preventing the caking was insufficient and the dissolution time was elongated by the caking.

The most excellent results were Obtained when all preservative was potassium salt or pyrosulfite (Nos. 6 to 9) in the present invention.

When at least 30% by weight of the particles of the powdery bleaching agent had a diameter of 150μm or below, preferred results were obtained and, moreover, when at least 35% by weight of the particles had such a small diameter as above, still preferred results were obtained (Nos. 9 to 11).

Thus it will be apparent that the powdery bleach-fixing composition of one-part constitution of the present invention is in such a compact form and has an excellent preservability and that a solution of the composition can be easily prepared.

EXAMPLE 2

The surface of a paper support having the both surfaces laminated with polyethylene was subjected to corona discharge treatment. Then a subbing layer comprising gelatin containing sodium dodecylbenzenesulfonate was formed thereon and further photographic constituent layers were formed thereon to prepare a multi-layer color printing paper having a layer constitution which will be described below. The coating solutions were prepared as will be described below. Preparation of coating solution for forming the fifth layer:

50.0 ml of ethyl acetate and 14.0 g of a solvent (Solv-6) were added to a mixture of 32.0 g of cyan coupler (ExC), 3.0 g of color image stabilizer (Cpd-2), 2.0 g of color image stabilizer (Cpd-4), 18.0 g of color image stabilizer (Cpd-6), 40.0 g of color image stabilizer (Cpd-7) and 5.0 g of color image stabilizer (Cpd-8) to obtain a solution. The resultant solution was added to 500 ml of 20% aqueous gelatin solution containing 8 ml of sodium dodecylbenzenesulfonate. The obtained mixture was emulsion-dispersed with an ultrasonic homogenizer to obtain an emulsified dispersion. Separately, a silver chlorobromide emulsion [a mixture of an emulsion of large size cubic grains having an average size of 0.58μm and an emulsion of small size cubic grains having an average size of 0.45 μm in a molar ratio of 1:4 (in terms of Af)] was prepared. The coefficient of variation of the grain size distribution was 0.09 and 0.11 in both emulsions, respectively. In both emulsions, 0.6 molar % of AgBr was locally contained in a part of the grain surface). A red-sensitive sensitizing dye E was contained in both emulsions in amounts of $0.9\times10^{-4}$ mol and $1.1\times10^{-4}$ mol, respectively. The chemical aging of the emulsion was conducted by adding a sulfur sensitizer and gold sensitizer. The emulsified dispersion prepared as described above was mixed with this red-sensitive silver chlorobromide emulsion to obtain a solution to be used as the coating solution for forming the fifth layer, which had a composition which will be described below.

The coating solutions for forming the first to the fourth layers, the sixth layer and the seventh layer were prepared in the same manner as that of the coating solution for forming the fifth layer. Sodium salt of 1-hydroxy-3,5-dichloro-s-triazine was used as the hardener for gelatin in the respective layers.

Cpd-10 and Cpd-11 were incorporated into the respective layers so that the total amounts of them would be 25.0 mg/m$^2$ and 50.0 mg/m$^2$, respectively.

Spectral sensitizing dyes listed below were incorporated into the silver chlorobromide emulsions for forming the photosensitive emulsion layers.

[Blue-sensitive emulsion layer]

Sensitizing dye A

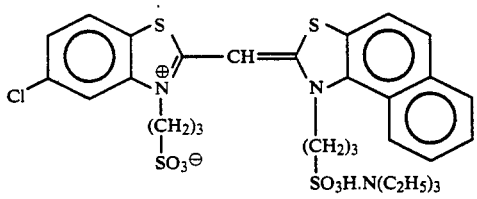

and sensitizing dye B

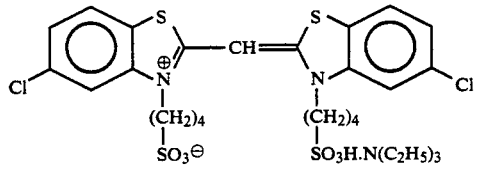

(each in amounts of $2.0\times10^{-4}$ mol and $2.5\times10^{-4}$ mol, per mol of the silver halide, for the large-size grain emulsion and small-size grain emulsion, respectively).

[Green-sensitive emulsion layer]

Sensitizing dye C

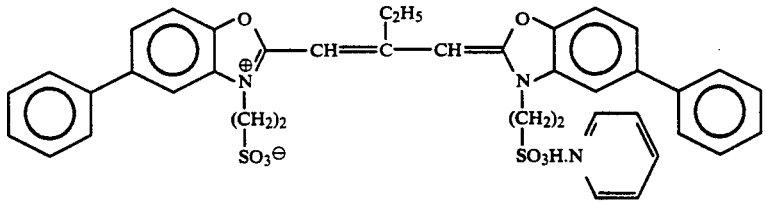

(in amounts of $4.0\times10^{-4}$ mol and $5.6\times10^{-4}$ mol, per mol of the silver halide, for the large-size grain emulsion and small-size grain emulsion, respectively).

and sensitizing dye D

-continued

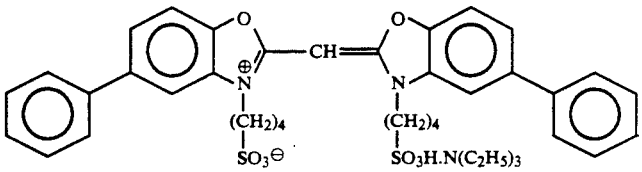

(in amounts of $7.0 \times 10^{-5}$ mol and $1.0 \times 10^{-5}$ mol, per mol of the silver halide, for the large-size grain emulsion and small-size grain emulsion, respectively).

[Red-sensitive emulsion layer]
Sensitizing dye E

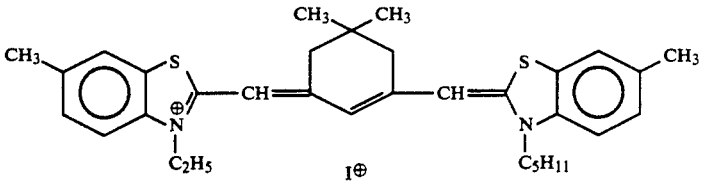

(in amounts of $0.9 \times 10^{-4}$ mol and $1.1 \times 10^{-4}$ mol, per mol of the silver halide, for the large-size grain emulsion and small-size grain emulsion, respectively).

In addition, the following compound was added in an amount of $2.6 \times 10^{-3}$ mol per mol of the silver halide.

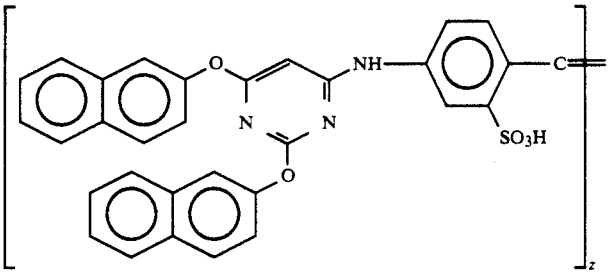

1-(5-Methylureidophenyl)-5-mercaptotetrazole was added to the blue-sensitive emulsion layer, green-sensitive emulsion layer and red-sensitive emulsion layer in amounts of $8.5 \times 10^{31\ 5}$ mol, $7.7 \times 10^{-4}$ mol and $2.5 \times 10^{-4}$ mol, respectively, per mol of the silver halide.

4-Hydroxy-6-methyl-1,3,3a,7-tetrazaindene was added to the blue-sensitive layer and green-sensitive layer in amounts of $1 \times 10^{-4}$ mol and $2 \times 10^{-4}$ mol, respectively, per mol of the silver halide.

Further, the following dye was incorporated into the emulsion layer for prevention of irradiation (the numeral in the parentheses being the amount).

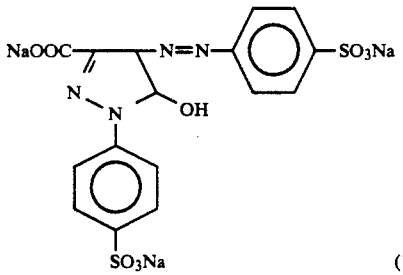

(10 mg/m²)

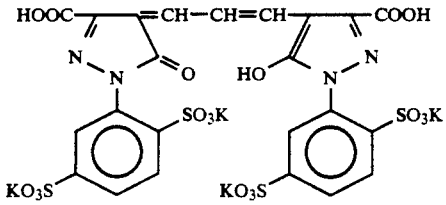

(10 mg/m²)

-continued

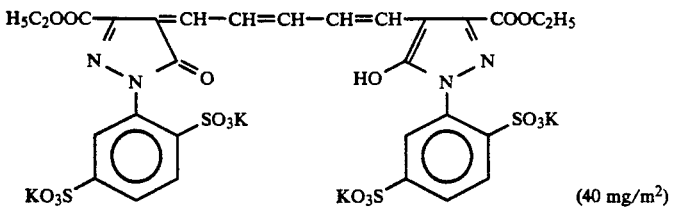

(40 mg/m²)

and

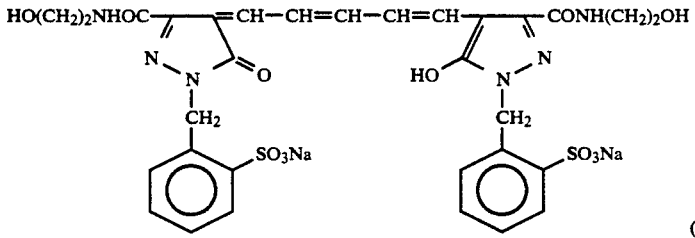

(20 mg/m²)

Layer constitution

The composition of each layer will be given below. The numerals indicating the amount of the coating solution are given by g/m². The amount of the silver halide emulsion is given in terms of silver.

| | |
|---|---|
| Support: | |
| Polyethylene-laminated paper [containing a white pigment ($TiO_2$) and bluing dye (ultramarine) in the polyethylene on the first layer side] | |
| The first layer (blue-sensitive emulsion layer) | 0.30 |
| Silver chlorobromide emulsion [cubic; a mixture of large size grain emulsion having average grain size of 0.88 μm and small size grain emulsion having average grain size of 0.70 μm in a molar ratio of 3:7 (in terms of Ag); the coefficient of variation of the grain size distribution being 0.08 and 0.10, respectively; and 0.3 molar % of silver bromide being localized in a part of the grain surface in both emulsion] | |
| Gelatin | 1.22 |
| Yellow coupler (ExY) | 0.82 |
| Color image stabilizer (Cpd-1) | 0.19 |
| Solvent (Solv-3) | 0.18 |
| Solvent (Solv-7) | 0.18 |
| Color image stabilizer (Cpd-7) | 0.06 |
| The second layer (color-mixing inhibiting layer) | |
| Gelatin | 0.64 |
| Color-mixing inhibitor (Cpd-5) | 0.10 |
| Solvent (Solv-1) | 0.16 |
| Solvent (Solv-4) | 0.08 |
| The third layer (green-sensitive emulsion layer) | |
| Silver chlorobromide emulsion [cubic; a mixture of large size grain emulsion having average grain size of 0.55 μm and small size grain emulsion having average grain size of 0.39 μm in a molar ratio of 1:3 (in terms of Ag); the coefficient of variation of the grain size distribution being 0.10 and 0.08, respectively; and 0.8 molar % of AgBr being localized in a part of the grain surface in both emulsions] | 0.12 |
| Gelatin | 1.33 |
| Magenta coupler (ExM) | 0.23 |
| Color image stabilizer (Cpd-2) | 0.03 |
| Color image stabilizer (Cpd-3) | 0.16 |
| Color image stabilizer (Cpd-4) | 0.02 |
| Color image stabilizer (Cpd-9) | 0.02 |
| Solvent (Solv-2) | 0.40 |
| The fourth layer (ultraviolet absorbing layer) | |
| Gelatin | 1.41 |
| Ultraviolet absorber (UV-1) | 0.47 |
| Color-mixing inhibitor (Cpd-5) | 0.05 |
| Solvent (Solv-5) | 0.24 |
| The fifth layer (red-sensitive emulsion layer) | |
| Silver chlorobromide emulsion [cubic; a mixture of large size grain emulsion having average grain size of 0.58 μm and small size grain emulsion having average grain size of 0.45 μm in a molar ratio of 1:4 (in terms of | 0.23 |

-continued

| | |
|---|---|
| Ag); the coefficient of variation of the grain size distribution being 0.09 and 0.11, respectively; and 0.6 molar % of AgBr being localized in a part of the grain surface in both emulsions] | |
| Gelatin | 1.04 |
| Cyan coupler (ExC) | 0.32 |
| Color image stabilizer (Cpd-2) | 0.03 |
| Color image stabilizer (Cpd-4) | 0.02 |
| Color image stabilizer (Cpd-6) | 0.18 |
| Color image stabilizer (Cpd-7) | 0.40 |
| Color image stabilizer (Cpd-8) | 0.05 |
| Solvent (Solv-6) | 0.14 |
| The sixth layer (Ultraviolet absorbing layer) | |
| Gelatin | 0.48 |
| Ultraviolet absorber (UV-1) | 0.16 |
| Color-mixing inhibitor (Cpd-5) | 0.02 |
| Solvent (Solv-5) | 0.08 |
| The seventh layer (protective layer) | |
| Gelatin | 1.10 |
| Acryl-modified polyvinyl alcohol copolymer (degree of modification: 17%) | 0.17 |
| Liquid paraffin | 0.03 |

Yellow coupler (ExY)

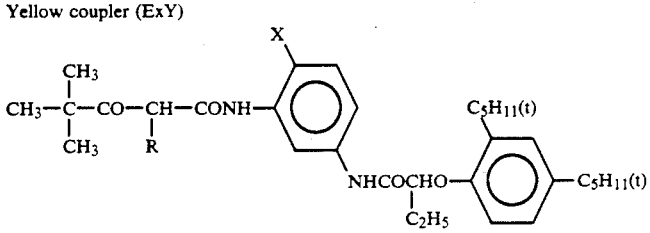

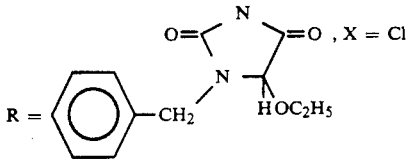

and

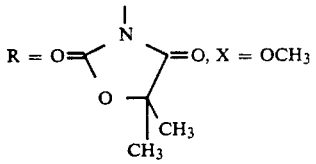

1:1 mixture (molar ratio)

Magenta coupler (ExM)

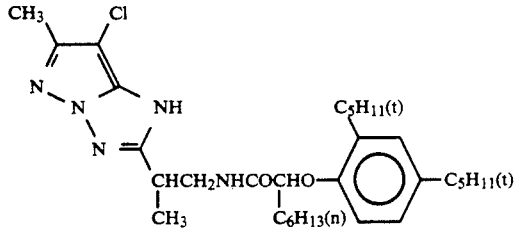

Cyan coupler (ExC)

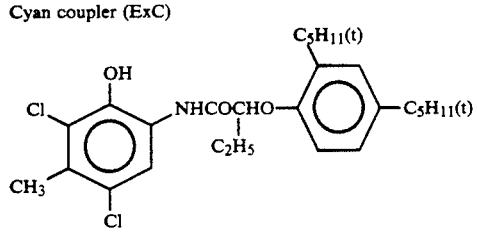

and

-continued
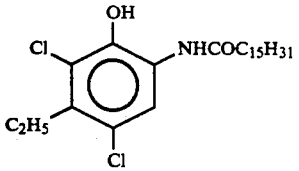
1:1 mixture (molar ratio)
color image stabilizer (Cpd-1)
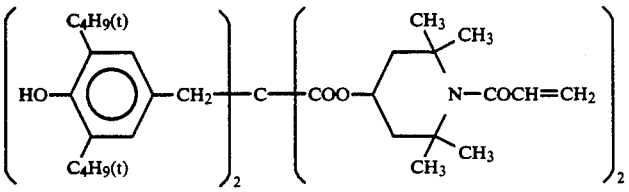
color image stabilizer (Cpd-2)
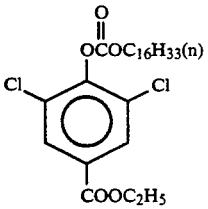
color image stabilizer (Cpd-3)
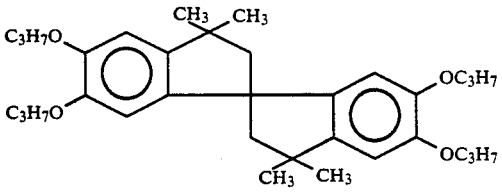
color-mixing stabilizer (Cpd-4)
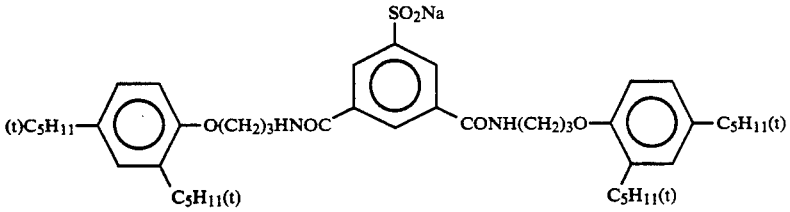
color-mixing stabilizer (Cpd-5)
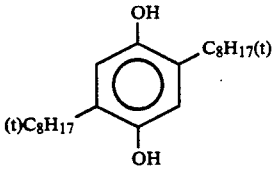
color image stabilizer (Cpd-6)
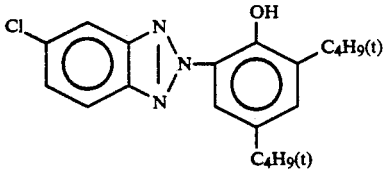

-continued
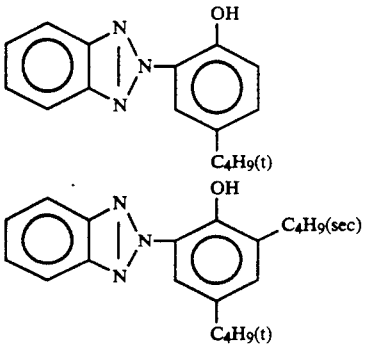
2:4:4 mixture (weight ratio)
color image stabilizer (Cpd-7)
$$\left(CH_2-\underset{\substack{|\\ CONHC_4H_9(t)}}{CH}\right)_n$$
average molecular weight 60,000
color image stabilizer (Cpd-8)
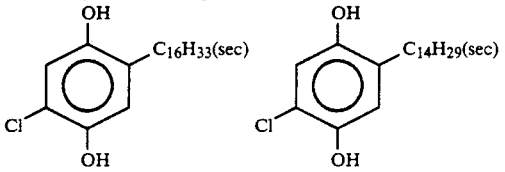
1:1 mixture (weight ratio)
color image stabilizer (Cpd-9)
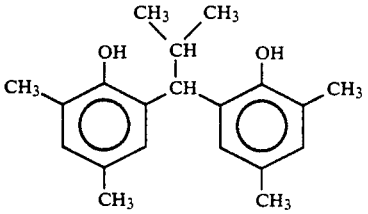
Preservative (Cpd-10)
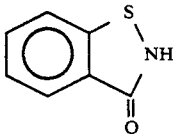
Preservative (Cpd-11)
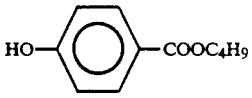
Ultraviolet absorber (UV-1)
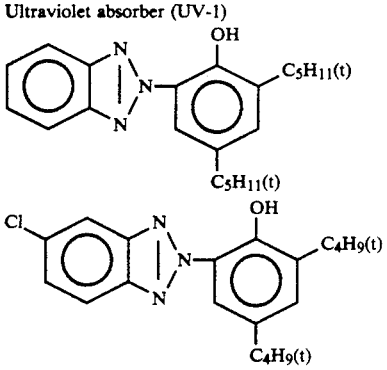

-continued

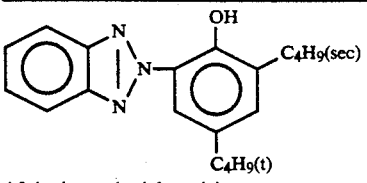

4:2:4 mixture (weight ratio)

Solvent (Solv-1)

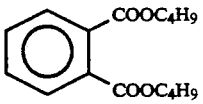

Solvent (Solv-2)

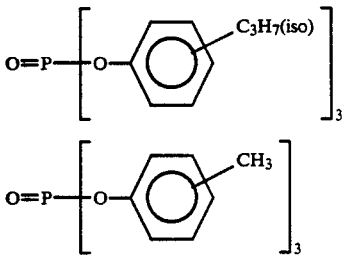

1:1 mixture (volume ratio)

Solvent (Solv-3)

$O{=}P{+}O{-}C_9H_{19}(iso))_3$

Solvent (Solv-4)

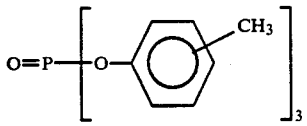

Solvent (Solv-5)

$(COOC_8H_{17})_2(CH_2)_8$

Solvent (Solv-6)

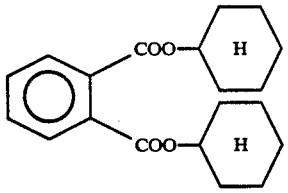

and $C_8H_{17}CHCH(CH_2)_7COOC_8H_{17}$ (O)

80:20 mixture (volume ratio)

Solvent (Solv-7)

$C_8H_{17}CHCH(CH_2)_7COOC_8H_{17}$ (O)

The maximum density of cyan dye and yellow density (stain) in an unexposed part of the sample prepared as described above were determined by the following processing steps with processing solutions given below:

| Processing step | Temperature | Time |
|---|---|---|

-continued

| | | |
|---|---|---|
| Color development | 38.5° C. | 45 sec |
| Bleach fixing | 30 to 35° C. | 45 sec |
| Rinse (1) | 30 to 35° C. | 20 sec |
| Rinse (2) | 30 to 35° C. | 20 sec |
| Rinse (3) | 30 to 35° C. | 20 sec |
| Drying | 70 to 80° C. | 60 sec |
| [Color developer] | | In the tank |

-continued

| | |
|---|---|
| Water | 800 ml |
| Ethylenediaminetetraacetic acid | 3.0 g |
| Sodium 4,5-dihydroxybenzene-1,3-sulfonate | 0.5 g |
| Potassium bromide | 0.015 g |
| Triethanolamine | 8.0 g |
| Sodium chloride | 4.1 g |
| Potassium carbonate | 25 g |
| Disodium N,N-bis(sulfonatoethyl)hydroxyamine | 4.0 g |
| 4-Amino-3-methyl-N-ethyl-N-[β (methanesulfonamido)tyl]-aniline sulfate | 5.0 g |
| Fluorescent brightener (WHITEX 4B) (a product of Sumitomo Chemical Co., Ltd.) | 1.0 g |
| Sodium triisopropylnaphthalene(β)sulfonate | 0.1 g |
| Water | ad 1000 ml |
| pH (25° C.) | 10.05 |

The bleach-fixing solution used was the powdery bleach-fixing agent K in Table 6 of 1 part constitution as in Example 1. For comparison, a solution prepared by successively adding chemicals according to the formulation K (not 1 part constitution or simultaneous mixing) was also used.

Rinse

Ion-exchanged water (calcium content and magnesium content: each 3 ppm or below).

The sample thus prepared by application of the coating solutions was subjected to step wedge exposure with a sensitometer (FWH mfd. by Fuji Photo Film Co., Ltd.; color temperature of the light source: 3200° K.) in such a manner that the exposure would be 250 CNS after exposure for 0.1 sec).

The coated sample thus obtained was processed by the above-described processing steps with the above-described processing solutions, and then the maximum density of cyan dye and yellow density (stain) in an unexposed part of the sample prepared as described above were determined.

The results obtained by using the bleach-fixing solution D in Example 1 were excellent and equivalent to those obtained by using a fresh bleach-fixing solution having the same composition.

EXAMPLE 3

A bleach-fixing solution used comprised the following constituents (for 10 l scale). The following constituents were each in the form of a powder (solid).

| | |
|---|---|
| Ferric ammonium ethylenediaminetetraacetate dihydrate* | 550 g |
| Sodium ferric ethylenediaminetetraacetate trihydrate* | 580 g |
| Ammonium thiosulfate (particle diameter: 10 to 1000 μm) | 10.0 mol |
| Ethylenediaminetetraacetic acid (particle diameter: 10 to 300 μm) | 30 gram |
| Preservative (refer to Table 7) (particle diameter: 10 to 1000 μm) | 1.4 mol |
| Organic acid salt (refer to Table 7) (particle diameter: 10 to 1000 μm) | refer to Table 7 |

*Particle diameter was 30 to 300 μm, and 30% by weight of the grains had a diameter of 150 μm or below.

These components were thoroughly blended together and fed into a bag made of a laminated resin film of polyethylene / polypropylene / ethylene - vinyl acetate copolymer / polyethylene (thickness: 10 μm) to prepare processing agents A to N.

The processing agents A to N prepared as described above were stored at 50° C. at relative humidity of 90% under a load of 1 kg/100 $cm^2$ for 8 weeks and then dissolved in water kept at 10° C. with a stirrer provided with a propeller shaft under predetermined stirring conditions to obtain 10 l of the final solution.

In the dissolution of the above-described processing agents A to N in water kept at 10° C., the dissolution time and smell were examined.

The dissolution time was macroscopically determined with an infrared scope.

The smell was determined by an organoleptic test conducted by five subjects (a) to (e) from the preparation period to 10 min after completion of the preparation.

The smell was classified into the following five ranks:

Smell

0: no smell at all,

1: very weak smell which does not displease the subject at all,

2: weak smell which does not displease the subject,

3: smell which slightly displeases the subject, and

4: strong smell which displeases the subject.

The degree of caking of the powder was also determined in the same manner as that of Example 1. The results are given in Table 7.

TABLE 7

| No. | Bleach-fixing composition | Preservative | Organic acid salt (pKa)* | Amount |
|---|---|---|---|---|
| 1 | A | $Na_2S_2O_5$ | — | — |
| 2 | B | $Na_2S_2O_5$ (granules with ammonium thiosulfate; average diameter: 300 μm) | — | — |
| 3 | C | $Na_2S_2O_5$ | ammonium acetate (4.76) | 2.0 mol |
| 4 | D | $K_2S_2O_5$ | — | — |
| 5 | E | " | ammonium carbonate (6.4, 10.3) | 2.0 mol |
| 6 | F | " | ammonium acetate (4.76) | " |
| 7 | G | " | pottassium oxalate (4.27) | " |
| 8 | H | " | ammonium succinate (4,21, 5.64) | " |
| 9 | I | " | ammonium salicylate (2.96) | " |
| 10 | J | " | ammonium acetate (4.76) | 0.3 mol |
| 11 | K | " | " | 0.6 mol |
| 12 | L | " | " | 1.0 mol |
| 13 | M | " | " | 4.0 mol |
| 14 | N | " | " | 10.0 mol |

TABLE 7-continued

| No. | Degree of caking** | Dissolution time (min) | Smell test (a) | (b) | (c) | (d) | (e) |
|---|---|---|---|---|---|---|---|
| 1 | XX | 21.5 | 2 | 3 | 4 | 3 | 3 |
| 2 | XX | 18.0 | 3 | 3 | 4 | 3 | 3 |
| 3 | XX | 22.0 | 1 | 1 | 1 | 1 | 1 |
| 4 | ◎ | 5.5 | 2 | 2 | 3 | 2 | 3 |
| 5 | ○ | 7.5 | 2 | 2 | 3 | 2 | 2 |
| 6 | ◎ | 3.0 | 0 | 1 | 1 | 0 | 0 |
| 7 | ◎ | 4.0 | 1 | 0 | 1 | 1 | 0 |
| 8 | ◎ | 3.5 | 0 | 0 | 1 | 1 | 1 |
| 9 | ○ | 8.0 | 3 | 2 | 3 | 3 | 2 |
| 10 | ◎ | 5.5 | 2 | 2 | 3 | 3 | 2 |
| 11 | ◎ | 4.0 | 1 | 1 | 2 | 2 | 1 |
| 12 | ◎ | 3.5 | 0 | 1 | 1 | 0 | 1 |
| 13 | ◎ | 4.0 | 1 | 0 | 1 | 0 | 0 |
| 14 | ○ | 8.0 | 2 | 2 | 3 | 2 | 3 |

Nos. 1 to 3 are Comparative Examples, and Nos. 4 to 14 are Examples of the present invention.
*Determined according to "Ion equilibrium" (written by H. Freiser and Q. Fernando and published by Kagaku Dojin)
**Determination of degree of caking:
◎: The powder was dry and not caked at all.
○: Although small masses were formed, they practically caused no problem.
Δ: Although the powder was partially coagulated, the formed masses could be broken by hand, which practically posed no problem.
X: The powder was partially coagulated to form mases which could not be broken by hand, which was practically troublesome.
XX: The powder was wholly caked and could not be easily taken out of the bag, which was practically seriously troublesome.

It is apparent from Table 7 that according to the constitution of the present invention, the caking of the powder is remarkably inhibited, the dissolution time is short and the processability is remarkably improved.

It will be understood from Experiment Nos. 4 to 9 that in the present invention, the use of an organic acid or its salt in the form of powder (Nos. 6 to 8) having an acid dissolution constant (pKa) of 4 to 6 is preferred for reduction of the dissolution time and inhibition of generation of smell in the course of the dissolution.

It will be understood from Experiment Nos. 6 and 10 to 14 that the amount of the organic acid or its salt having a pKa of 4 to 6 is particularly preferably 5 to 50 molar % based on the thiosulfate (Nos. 6 and 11 to 13).

EXAMPLE 4

A silver halide emulsion was prepared as described below.

Preparation of emulsion a0

3.3 g of sodium chloride and 24 ml of 1N sulfuric acid were added to 3% aqueous solution of gelatin treated with lime. An aqueous solution of 0.2 mol of silver nitrate and an aqueous solution containing 0.2 mol of sodium chloride and 5 μg of rhodium trichloride were added to that solution under vigorous stirring at 75° C., and they were mixed. Then an aqueous solution containing 0.79 mol of silver nitrate and an aqueous solution containing 0.79 mol of sodium chloride and 1.8 mg of potassium ferrocyanide was added to the mixture under vigorous stirring at 75° C. to obtain a mixture. 5 min after completion of the addition of the aqueous silver nitrate solution and aqueous alkali halide solution, sensitizing dyes A and B were added each in an amount of $2.0\times10^{4}$ mol, per mol of the silver halide, to the resultant mixture at 50° C. After 15 min, isobutene/-monosodium maleate copolymer was added to the reaction mixture to form a precipitate, which was washed with water and desalted. Then 90.0 g of gelatin treated with lime was added to the product to adjust pH and pAg of the emulsion to 6.6 and 7.2, respectively. Fine grains of silver bromide (size: 0.05 μm) in an amount corresponding to 0.01 mol of silver nitrate and an aqueous solution containing 0.1 mg of potassium hexachloroiridate (IV) were mixed therein under vigorous stirring. $1\times10^{-5}$ mol/mol-Ag of a sulfur sensitizer, $1\times10^{-5}$ mol/mol-Ag of chloroauric acid and 0.2 g/mol-Ag of nucleic acid were added thereto and the optimum chemical sensitization was conducted at 50° C. The shape, grain size, and grain size distribution of the obtained silver chlorobromide grains a0 were determined from an electron photomicrograph thereof. The silver halide grains were cubic. The grain size and coefficient of variation were 0.75 μm and 0.08, respectively. The grain size was given in terms of the average diameter of a circle having an area equal to the projected area of the grain, and the coefficient of variation was given by dividing the standard deviation of the grain size by average grain size.

Preparation of emulsions b0 and c0

Emulsion b0 was prepared in the same manner as that of the preparation of emulsion a0 except that the grain-formation temperature was converted to 50° C. and that the sensitizing dyes C and D (in amount s of $4.0\times10^{-4}$ mol and $7.0\times10^{-5}$ mol, respectively, per mol of the silver halide) were used. Further emulsion c0 was prepared in the same manner as that of the preparation of emulsion a0 except that the grain-formation temperature was converted to 55° C. and that sensitizing dye E (in an amount of $1\times10^{-4}$ mol per mol of the silver halide) was used.

The shape of the grains and grain size of the obtained silver chlorobromide grains in b1 and c0 were determined from electron micrographs of them. The silver halide grains were cubic. The grain sizes were 0.43 μm and 0.47 μm, respectively. The sensitizing dyes A to E were the same as those used in Example 2.

A senstivie material 101 was prepared as described below.

The surface of a paper support having the both surfaces laminated with polyethylene containing 15% by weight of a white pigment was subjected to corona discharge treatment. Then a subbing layer comprising gelatin containing sodium dodecylbenzenesulfonate was formed thereon and further photographic constituent layers were formed thereon to prepare a multi-layer color printing paper (101) having a layer constitution which will be described below. (The centerline surface roughness of the support before the formation of the photographic layers was 0.12μm.)

Preparation of coating solution for forming the first layer 153.0 g of yellow coupler (ExY), 15.0 g of color image stabilizer (Cpd-1), 7.5 g of color image stabilizer (Cpd-2) and 16.0 g of color image stabilizer (Cpd-3) were dissolved in a mixture of 25 g of solvent (Solv-1), 25 g of solvent (Solv-2) and 180 ml of ethyl acetate to obtain a solution. The resultant solution was emulsion-dispersed in 1,000 ml of 10% aqueous gelatin solution containing 60 ml of 10% sodium dodecylbenzenesulfonate and 10 g of citric acid to obtain an emulsified dispersion A. Thus obtained emsulsified dispersion A was mixed with the silver chlorobromide emulsion a0 prepared as described above to obtain a solution for forming the first layer which had a composition that will be described below.

The coating solutions for forming the second to the seventh layers were prepared in the same manner as that of the coating solution for forming the fifth layer. Sodium salt of 1-hydroxy-3,5-dichloro-s-triazine was used as the hardener for gelatin in the respective layers.

Cpd-14 and Cpd-15 were incorporated into the respective layers so that the total amounts of them would be 25.0 mg/m$^2$. $2.5\times10^{-3}$, $4.0\times10^{-3}$ and $2.5\times10^{-4}$ mol, per mol of the silver halide, of 1-(5-methylureidophenyl)-5 -mercaptotetrazole was incorporated into the blue-sensitive emulsion layer, green-sensitive emulsion layer and red-sensitive emulsion layer, respectively. $1\times10^{-4}$ mol and $2\times10^{-4}$ mol, per mol of the silver halide, of 4-hydroxy-6-methyl-1,3,3a,7-tetrazaindene was incorporated into the blue-sensitive emulsion layer and green-sensitive emulsion layer, respectively.

$2.6\times10^{-3}$ mol, per mol of the silver halide, of a compound of the chemical formula 6 which was the same as that used in Example 2 was incorporated into the red-sensitive layer.

The dye of the chemical formula 7 which was the same as that used in Example 2 in the same amount as that in Example 2 was incorporated into the emulsion layers for inhibiting the irradiation.

Layer constitution

The composition of each layer will be given below. The numerals indicating the amount of the coating solution are given by g/m$^2$. The amount of the silver halide emulsion is given in terms of silver.

| | |
|---|---|
| Polyethylene-laminated paper: [containing a white pigment ($TiO_2$; 15% by weight) and bluing dye (ultramarine) in the polyethylene on the first layer side] | |
| The first layer (blue-sensitive emulsion layer) | |
| Silver chlorobromide emulsion a0 prepared as described above | 0.27 |
| Gelatin | 1.22 |
| Yellow coupler (ExY) | 0.79 |
| Color image stabilizer (Cpd-1) | 0.08 |
| Color image stabilizer (Cpd-2) | 0.04 |
| Color image stabilizer (Cpd-3) | 0.08 |
| Solvent (Solv-1) | 0.13 |
| Solvent (Solv-2) | 0.13 |
| The second layer (color-mixing inhibiting layer) | |
| Gelatin | 0.90 |
| Color-mixing inhibitor (Cpd-4) | 0.06 |
| Solvent (Solv-7) | 0.03 |
| Solvent (Solv-2) | 0.25 |
| Solvent (Solv-3) | 0.25 |
| The third layer (green-sensitive emulsion layer) | |
| Silver chlorobromide emulsion b0 prepared as described above | 0.13 |
| Gelatin | 1.28 |
| Magenta coupler (ExM) | 0.16 |
| Color image stabilizer (Cpd-5) | 0.15 |
| Color image stabilizer (Cpd-2) | 0.03 |
| Color image stabilizer (Cpd-6) | 0.01 |
| Color image stabilizer (Cpd-7) | 0.01 |
| Color image stabilizer (Cpd-8) | 0.08 |
| Solvent (Solv-3) | 0.50 |
| Solvent (Solv-4) | 0.15 |
| Solvent (Solv-5) | 0.15 |
| The fourth layer (color mixing-inhibiting layer) | |
| Gelatin | 0.70 |
| Color-mixing inhibitor (Cpd-4) | 0.04 |
| Solvent (Solv-7) | 0.02 |
| Solvent (Solv-2) | 0.18 |
| Solvent (Solv-3) | 0.18 |
| The fifth layer (red-sensitive emulsion layer) | |
| Silver chlorobromide emulsion c0 prepared as described above | 0.18 |
| Gelatin | 0.80 |
| Cyan coupler (ExC) | 0.33 |
| Ultraviolet absorber (UV-2) | 0.18 |
| Color image stabilizer (Cpd-1) | 0.33 |
| Color image stabilizer (Cpd-6) | 0.01 |
| Color image stabilizer (Cpd-8) | 0.01 |

-continued

| Polyethylene-laminated paper: [containing a white pigment ($TiO_2$; 15% by weight) and bluing dye (ultramarine) in the polyethylene on the first layer side] | |
|---|---|
| Color image stabilizer (Cpd-9) | 0.01 |
| Color image stabilizer (Cpd-10) | 0.01 |
| Color image stabilizer (Cpd-11) | 0.01 |
| Solvent (Solv-1) | 0.01 |
| Solvent (Solv-6) | 0.22 |
| The sixth layer (Ultraviolet absorbing layer) | |
| Gelatin | 0.48 |
| Ultraviolet absorber (UV-1) | 0.38 |
| Color image stabilizer (Cpd-5) | 0.02 |
| Color image stabilizer (Cpd-12) | 0.15 |
| The seventh layer (protective layer) | |
| Gelatin | 1.10 |
| Acryl-modified polyvinyl alcohol copolymer (degree of modification: 17%) | 0.05 |
| Liquid paraffin | 0.02 |
| Color image stabilizer (Cpd-13) | 0.01 |

(ExY) Yellow coupler

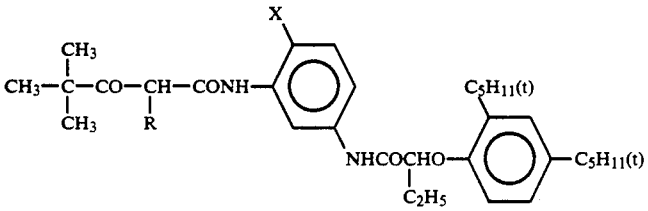

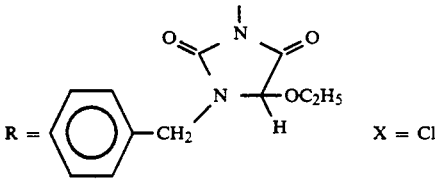

and

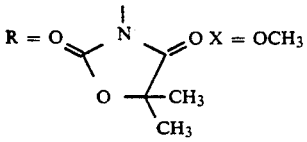

1:1 mixture (molar ratio)

(ExM) Magent coupler

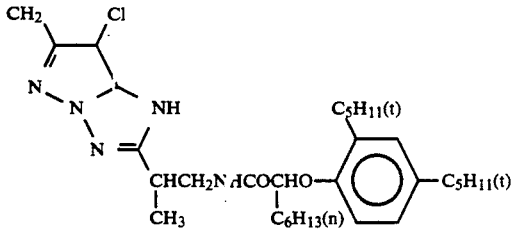

(ExC) Cyan coupler

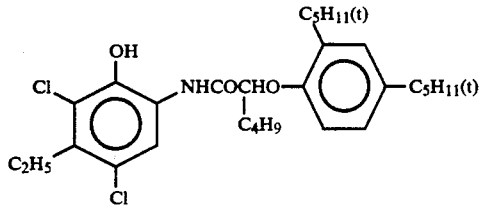

and

-continued

Polyethylene-laminated paper:
[containing a white pigment ($TiO_2$; 15% by weight) and bluing dye (ultramarine) in the polyethylene on the first layer side]

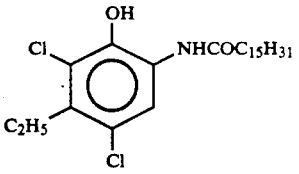

3:7 mixture (molar ratio)

(Cpd-1) color image stabilizer

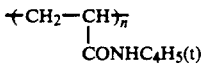

average molecular weight 60,000

(Cpd-2) color image stabilizer

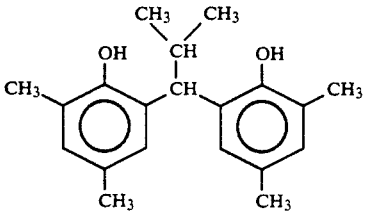

(Cpd-3) color image stabilizer

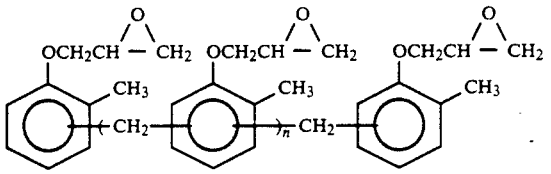

n = 7~8 (average)

(Cpd-4) color-mixing inhibitor

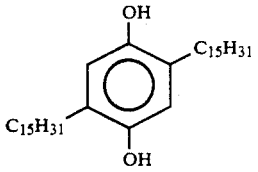

(Cpd-5) color image stabilizer

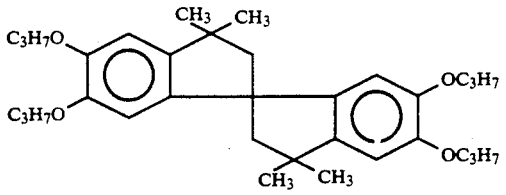

(Cpd-6) color image stabilizer

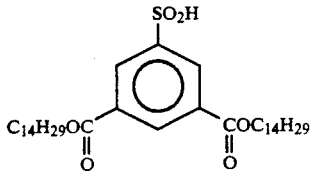

(Cpd-7) color image stabilizer

-continued

Polyethylene-laminated paper:
[containing a white pigment ($TiO_2$; 15% by weight) and bluing dye (ultramarine) in the polyethylene on the first layer side]

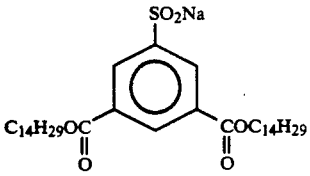

(Cpd-8) color image stabilizer

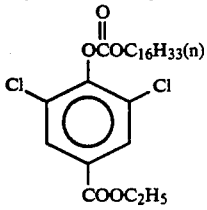

(Cpd-9) color image stabilizer

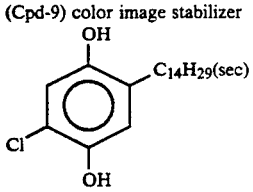

(Cpd-10) color image stabilizer

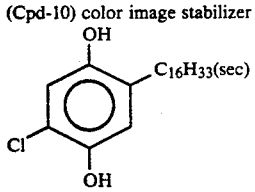

(Cpd-11) color image stabilizer

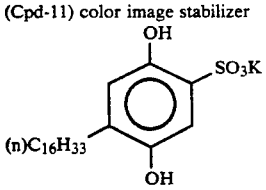

(Cpd-12) color image stabilizer

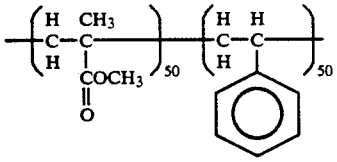

average molecular weight
about $6.0 \times 10^4$ (Cpd-13) color image stabilizer

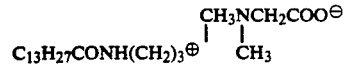

(Cpd-14) Preservative

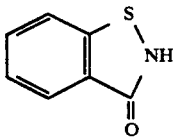

(Cpd-15) Preservative

-continued
Polyethylene-laminated paper:
[containing a white pigment ($TiO_2$; 15% by weight) and bluing dye (ultramarine) in the polyethylene on the first layer side]
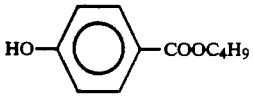
(UV-1) Ultraviolet absorber
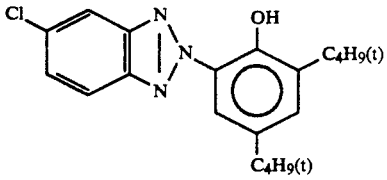
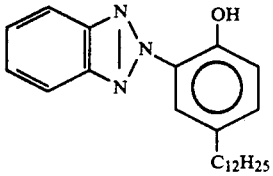
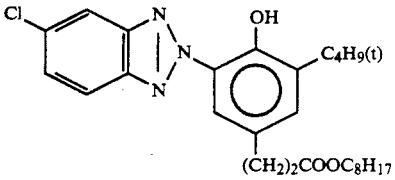
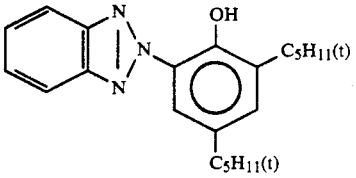
(1), (2), (3), (4) = 1:5:10:5 mixture (weight ratio)
(UV-2) Ultraviolet absorber
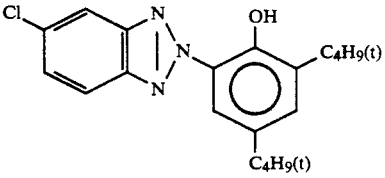
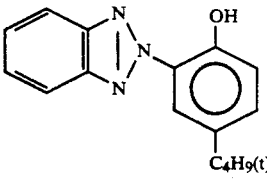
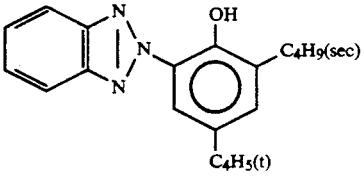
(1), (2), (3) = 1:2:2 mixture (weight ratio)
(solv-1) Solvent
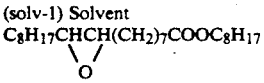
(Solv-2) Solvent -continued

| |
|---|
| Polyethylene-laminated paper: [containing a white pigment ($TiO_2$; 15% by weight) and bluing dye (ultramarine) in the polyethylene on the first layer side] |

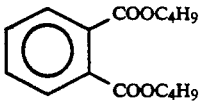

(Solv-3) Solvent

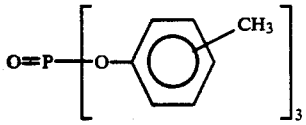

(Solv-4) Solvent

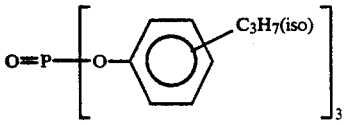

(Solv-5) Solvent

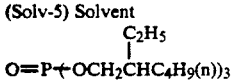

(Solv-6) Solvent

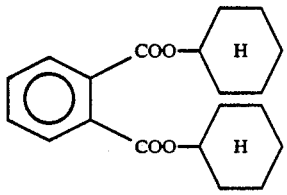

(Solv-7) Solvent

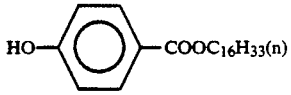

The photosensitive material 101 prepared as described above was subjected to a continuous test by the following processing steps with processing solutions given below until the amount of the replenisher had reached twice as much as the capacity of the tank:

| Processing | Temperature | Time | Amount of replenisher* | Capacity of tank |
|---|---|---|---|---|
| Color development | 38.5° C. | 45 sec | 73 ml | 10 l |
| Bleach fixing | 35.0° C. | 45 sec | 54 ml | 10 l |
| Rinse-1 | 35.0° C. | 20 sec | — | 5 l |
| Rinse-2 | 35.0° C. | 20 sec | — | 5 l |
| Rinse-3 | 35.0° C. | 20 sec | — | 5 l |
| Rinse-4 | 35.0° C. | 30 sec | 242 ml | 5 l |
| Drying | 80° C. | 60 sec | — | — |

*Amount per $m^2$ of the photosensitive material (Rinses: four-tank countercurrent system from Rinse 4 to Rinse 1)

The compositions of the processing solutions were as given below.

| [Color developer] | [Tank] | [Replenisher] |
|---|---|---|
| water | 800 ml | 800 ml |
| Ethylenediaminetetraacetic acid | 3.0 g | 3.0 g |
| Disodium 4,5-dihydroxybenzene-1,3-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent brightener (WHITEX 4) (a product of Sumitomo Chemical Co., Ltd.) | 1.0 g | 3.0 g |
| Sodium sulfite | 0.1 g | 0.1 g |
| Disodium N,N-bis(sulfonatoethyl)-hydroxylamine | 5.0 g | 10.0 g |
| Sodium triisopropylnaphthalene(β)-sulfonate | 0.1 g | 0.1 g |
| N-ethyl-N-(β-methanesulfonamido-ethyl)-3-methyl-4-aminoaniline 3/2-sulfate monohydrate | 5.0 g | 11.5 g |
| Water | ad 1000 ml | 1000 ml |
| pH (25° C.; adjusted with potassium hydroxide or sulfuric acid) | 10.00 | 11.00 |

Bleach-fixing solution

The bleach-fixing solution used was the same solution of the powdery bleach-fixing agent (F in Table 7) of one-part constitution as that in Example 3. The pH of the solution immediately after the preparation was 4.8.

The bleach-fixing tank solution was prepared by diluting the bleach-fixing replenisher into a concentration of ½. The pH of the solution immediately after the preparation was 5.2.

For comparison, the same running test as that described above was conducted except that a replenisher and a tank solution prepared by successively adding chemicals (not one-part constitution or simultaneous mixing) were used.

| [Rinse] (The tank solution was the same as the replenisher) | |
|---|---|
| Sodium chlorinated isocyanurate | 0.02 g |
| Ion-exchanged water (electric conductivity: 5 μs/cm or below) | 1000 ml |
| pH | 6.5 |

The sample thus prepared by application of the coating solutions was subjected to step wedge exposure with a sensitometer (FWH mfd. by Fuji Photo Film Co., Ltd.; color temperature of the light source: 3200° K.) in such a manner that the exposure would be 250 CNS after exposure for 0.1 sec).

After completion Of the running test, the coated sample thus obtained was processed by the above-described processing steps with the above-described processing solutions, and then the maximum density of cyan dye and yellow density (stain) in an unexposed part of the sample prepared as described above were determined.

The results obtained by using the bleach-fixing solution F in Example 3 were excellent and equivalent to those obtained by using a fresh bleach-fixing solution having the same composition.

EXAMPLE 5

A photosensitive material 101 prepared in Example 4 was subjected to a continuous test by the following processing steps with processing solutions given below until the amount of the replenisher had reached twice as much as the capacity of the tank:

| Processing step | Temperature | Time | Amount of replenisher* | Capacity of tank |
|---|---|---|---|---|
| Color development | 35.0° C. | 45 sec | 161 ml | 10 l |
| Bleach fixing | 35.0° C. | 45 sec | 54 ml | 10 l |
| Stabilization-1 | 35.0° C. | 20 sec | — | 5 l |
| Stabilization-2 | 35.0° C. | 20 sec | — | 5 l |
| Stabilization-3 | 35.0° C. | 20 sec | — | 5 l |
| Stabilization-4 | 35.0° C. | 30 sec | 242 ml | 5 l |
| Drying | 80° C. | 60 sec | — | — |

*Amount per $m^2$ of the photosensitive material (Stabilizations: four-tank countercurrent system from Stabilization-4 to Stabilization-1)

The compositions of the processing solutions were as given below.

| [Color developer] | [Tank] | [Replenisher] |
|---|---|---|
| water | 800 ml | 800 ml |
| Lithium polystyrene sulfonate solution (30%) | 0.25 ml | 0.25 ml |
| 1-hydroxyethylidene-1,1-diphosphonic acid solution (60%) | 0.8 ml | 0.8 ml |
| Lithium sulfate(anhydride) | 2.7 g | 2.7 g |
| Triethanolamine | 8.0 g | 8.0 g |
| Potassium chloride | 1.8 g | — |
| Potassium bromide | 0.03 g | 0.025 g |
| Diethylhydroxylamine | 4.6 g | 7.2 g |
| Glycine | 5.2 g | 8.1 g |

-continued

| [Color developer] | [Tank] | [Replenisher] |
|---|---|---|
| Threonine | 4.1 g | 6.4 g |
| Potassium carbonate | 27 g | 27 g |
| Potassium sulfite | 0.1 g | 0.2 g |
| N-ethyl-N-(β-methanesulfonamidoethyl)3-methyl-4-aminoaniline 3/2sulfate monohydrate | 4.5 g | 7.3 g |
| Fluorescent brightener (4,4'-aminostilbene type) | 2.0 g | 3.0 g |
| Water | ad 1000 ml | 1000 ml |
| pH (25° C.; adjusted with potassium hydroxide or sulfuric acid) | 10.12 | 10.70 |

Bleach-fixing solution

The bleach-fixing replenisher solution used was the same solultion of the powdery bleach-fixing agent (F in Table 7) of one-part constitution as that in Example 3. The pH of the solution immediately after the preparation was 4.8. The bleach-fixing tank solution was prepared by diluting the bleach-fixing replenisher into a concentration of ½. The pH of the solution immediately after the preparation was 5.2.

For comparison, the same running test as that described above was conducted except that a replenisher and a tank solution prepared by successively adding chemicals (not one-part constitution or simultaneous mixing) were used.

| [Stabilizer] (The tank solution was the same as the replenisher) | |
|---|---|
| 1,2-benzothiazoline-3-on | 0.02 g |
| Polyvinylpyrrolidone | 0.05 g |
| Water | ad 1000 ml |
| pH | 7.0 |

The sample thus prepared by application of the coating solutions was subjected to step wedge exposure with a sensitometer (FWH mfd. by Fuji Photo Film Co., Ltd.; color temperature of the light source: 3200° K.) in such a manner that the exposure would be 250 CN S after exposure for 0.1 sec).

After completion of the running test, the coated sample thus obtained was processed by the above-described processing steps with the above-described processing solutions, and then the maximum density of cyan dye and yellow density (stain) in an unexposed part of the sample prepared as described above were determined. In this case, the pH of the breach-fixing solution was 6.5 when the running test was completed.

The results obtained by using the bleach-fixing solution F in Example 3 were excellent and equivalent to those obtained by using a fresh bleach-fixing solution having the same composition.

EXAMPLE 6

Fuji color Super FAV emulsion No. cp45AFG0922-047X available from Fuji Photo Film Co. Ltd. was used and subjected to the same following processing steps with processing solutions as in Example 5 until the amount of the replenisher had reached twice as much as the capacity of the tank, except for the following conditions:

Temperature at color development was changed to 38.0°0 C.

An amount of some components in the color developer was changed as follows:

| [Color developer] | [Tank] | [Replenisher A] |
|---|---|---|
| 1-hydroxyethylidene-1,1-diphosphonic acid solution (60%) | 1.5 ml | 1.5 ml |
| Lithium sulfate(anhydride) | 5.0 g | 5.0 g |
| Potassium chloride | 5.5 g | 3.0 g |

The color development was carreid out under regenaration system with overflow solution. Specifically, the color developer was regenarated as follows:

The overflow solution from the color developing bath was stocked in the stock tank. The replenisher A was used as a replenisher to the color developing bath until three liters of the overflow solution was stored in the tank. Thereafter, regenarated replenisher in which regenarating agent was added to the overflow solution was used. 450 ml of overflow solution per 1 liter of the overflow solution was discarded as waste, and regenarating agent and water were added to the reminding 550 ml so as to prepare 1 liter of regenarating solution. In this respect, the regenarating agent comprises supplemental components in such that the composition of the regenarating solution to which the regenerating agent has been added becomes the same as that of the replenisher A, and the supplemental components and their amount were determined by analyzing the overflow solution.

The bleach-fixing solution and stabilizer used were the same as those in Example 5 and the precessing was conducted in the same manner as in Example 5.

After completion of the running test, the maximum density of cyan dye and yellow density (stain) in an unexposed part of the sample prepared as described above were determined. In this case, the pH of the breach-fixing solution was 6.5 when the running test was completed.

The results obtained by using the bleach-fixing solution F in Example 3 were excellent and equivalent to those obtained by using a fresh bleach-fixing solution having the same composition.

Thus the present invention provides a powdery bleach-fixing composition of only one-part constitution in a compact form which has a high preservability and easy processability. The time necessitated for the preparation of the composition is reduced and generation of smell during the dissolution of the composition is inhibited. The caking of the powder which elongates the dissolution time can be inhibited.

What is claimed is:

1. A bleach-fixing composition for color photographic materials which has a one-part constitution comprising a mixture of at least the following three kinds of powdery compounds (1) to (3):

(1) a thiosulfate, (2) an iron (III) complex compound or a salt thereof, and (3) a salt selected from the group consisting of sulfites, bisulfites and pyrosulfites in a container, at least 50 molar % (in terms of sulfite ion equivalent) of the salt (3) being potassium salt.

2. The powdery bleach-fixing composition of claim 1, wherein at least 25% by weight of the solid iron (III) complex compound or salt thereof comprises a powder having a particle diameter of at most 150 μm.

3. The powdery bleach-fixing composition of claim 1, wherein the salt (3) is only potassium pyrosulfite.

4. The powdery bleach-fixing composition of claim 1, wherein the thiosulfite is ammonium thiosulfate.

5. The powdery bleach-fixing composition of claim 1, wherein the iron (III) complex compound or a salt thereof is a ferric complex of aminopolycarboxylic acid or salt thereof.

6. The powdery bleach-fixing composition of claim 1, wherein the salt of the (III) complex compound is a ferric complex sodium, potassium or ammonium of aminopolycarboxylic acid.

7. The powdery bleach-fixing composition of claim 1, wherein the composition comprises 30 to 80% by weight of thiosulfate, 10 to 50% by weight of the iron (III) complex compound or a salt thereof and 5 to 50% by weight of the salt selected from the group consisting of sulfites, bisulfites and pyrosulfites.

8. The powdery bleach-fixing composition of claim 1, wherein the thiosulfate, iron (III) complex compound or a salt thereof, and component (3) have a particle size of 10 to 3000 μm, 10 to 1000 μm and 10 to 3000 μm, respectively.

9. The powdery bleach-fixing composition of claim 1, wherein the composition comprises a powder of an organic acid having an acid dissociation constant of 4 to 6 or a salt thereof.

10. The powdery bleach-fixing composition of claim 9, wherein the composition comprises the organic acid or salt thereof in an amount of 5 to 50 mol % relative to an amount of thiosulfate.

* * * * *